US010683631B2

(12) United States Patent
Van Gemert

(10) Patent No.: US 10,683,631 B2
(45) Date of Patent: Jun. 16, 2020

(54) METHOD OF DECOUPLING A CYLINDER FROM A JAW IN A DEMOLITION TOOL AND LINK ASSEMBLY THEREOF

(71) Applicant: Caterpillar Work Tools B.V., s-Hertogenbosch (NL)

(72) Inventor: Johannes Lambert Leonardus Van Gemert, Mill (NL)

(73) Assignee: Caterpillar Work Tools B.V., s-Hertogenbosch (NL)

( * ) Notice: Subject to any disclaimer, the term of this patent is extended or adjusted under 35 U.S.C. 154(b) by 499 days.

(21) Appl. No.: 15/318,920

(22) PCT Filed: Jun. 25, 2015

(86) PCT No.: PCT/EP2015/064434
§ 371 (c)(1),
(2) Date: Dec. 14, 2016

(87) PCT Pub. No.: WO2015/197782
PCT Pub. Date: Dec. 30, 2015

(65) Prior Publication Data

US 2017/0114516 A1 Apr. 27, 2017

(30) Foreign Application Priority Data

Jun. 27, 2014 (EP) ..... 14174769

(51) Int. Cl.
*E02F 3/36* (2006.01)
*E02F 3/96* (2006.01)
(Continued)

(52) U.S. Cl.
CPC ..... *E02F 3/3604* (2013.01); *E02F 3/965* (2013.01); *E02F 9/006* (2013.01); *E02F 9/2271* (2013.01)

(58) Field of Classification Search
CPC ..... E02F 3/3604; E02F 3/966; E02F 9/006; E02F 9/2271; Y10T 29/53; Y10T 29/53443
(Continued)

(56) References Cited

U.S. PATENT DOCUMENTS 5,292,079 A 3/1994 Zakohji
5,474,242 A * 12/1995 Rafn ..... B23D 17/00 241/101.71
(Continued)

FOREIGN PATENT DOCUMENTS

DE 1115529 10/1961
DE 102009046227 5/2011
(Continued)

OTHER PUBLICATIONS

International Search Report dated Sep. 7, 2016, issued in PCT/EP2015/064434 (3 pages).
(Continued)

*Primary Examiner* — Sarang Afzali
*Assistant Examiner* — Darrell C Ford
(74) *Attorney, Agent, or Firm* — Finnegan, Henderson, Farabow, Garrett & Dunner, LLP

(57) ABSTRACT

A method of decoupling a cylinder from a jaw in a demolition tool is disclosed. The jaw may have spaced apart first and second lugs. The method may include unlocking a first end of a pin from a first lug. The pin may have a groove adjacent the first end. The method may include rotating the first and second lugs in a first direction (A) from a first lug position to a second lug position wherein the pin slides through the first and second lugs and the first end moves from the first lug to the second lug to uncouple the cylinder from the jaw. The method may also include engaging a locking element biasingly supported on the second lug into
(Continued)

the groove to retain the pin at the second lug. Further, the method may include moving the cylinder from between the spaced apart first and second lugs.

20 Claims, 13 Drawing Sheets

(51) Int. Cl.
*E02F 9/00* (2006.01)
*E02F 9/22* (2006.01)

(58) Field of Classification Search
USPC ..... 241/264, 266; 29/426.1, 426.3
See application file for complete search history.

(56) References Cited

U.S. PATENT DOCUMENTS 6,564,836 B2 * 5/2003 Cook ..... E02F 3/3604 144/24.12
6,877,259 B2 * 4/2005 Nishimura ..... E02F 3/3604 37/403
7,044,037 B2 * 5/2006 Cossette ..... B23D 31/008 83/13
7,690,880 B2 * 4/2010 Honeyman ..... E02F 3/3631 37/468
8,469,623 B2 * 6/2013 Luyendijk ..... E02F 3/364 37/468
2005/0241196 A1 * 11/2005 Martinez ..... E02F 9/006 37/468
2009/0269133 A1 * 10/2009 Van Amelsfoort ... E02F 3/3604 403/408.1
2010/0172731 A1 * 7/2010 Morin ..... E02F 3/3609 414/723
2011/0297773 A1 * 12/2011 Nye ..... E02F 3/965 241/101.73
2012/0018558 A1 * 1/2012 Gervais ..... B02C 1/04 241/101.74
2013/0320122 A1 12/2013 Ko
2015/0144724 A1 * 5/2015 Van Gemert ..... E02F 3/965 241/264
2017/0328027 A1 * 11/2017 Lanzl ..... E02F 3/3636

FOREIGN PATENT DOCUMENTS

DE 102010039420 2/2012
FR 976239 3/1951
SU 706588 12/1979

OTHER PUBLICATIONS

European Search Report dated Jan. 9, 2015, issued in EP 14 17 4769 (2 pages).

* cited by examiner

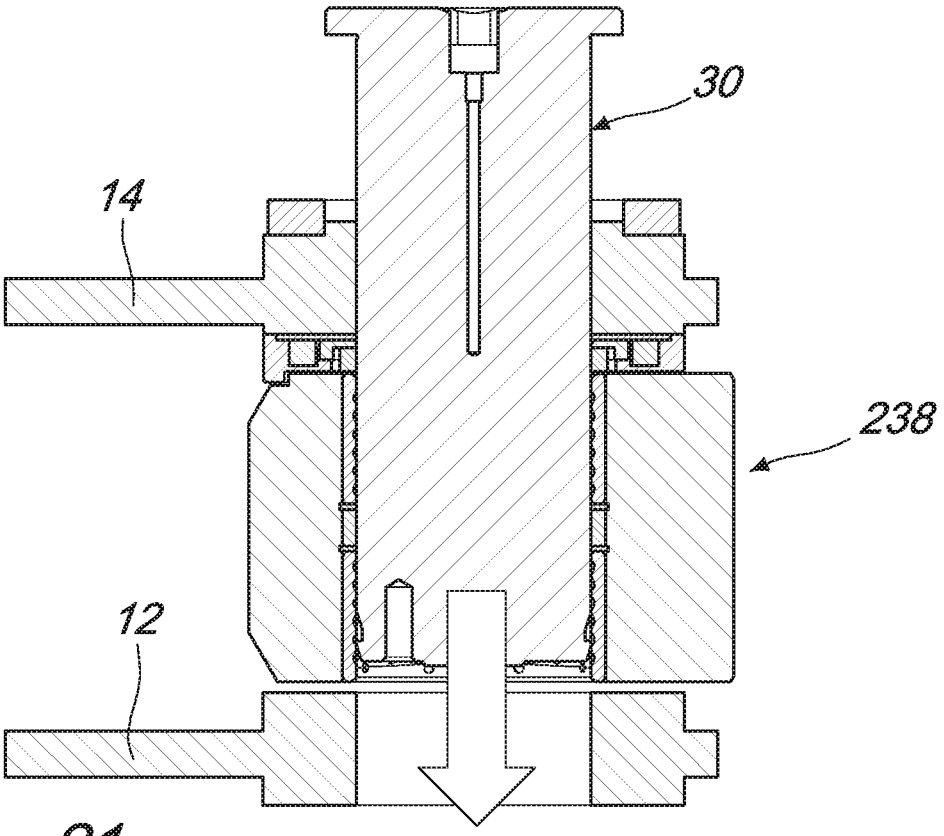
Fig. 21
Fig. 22
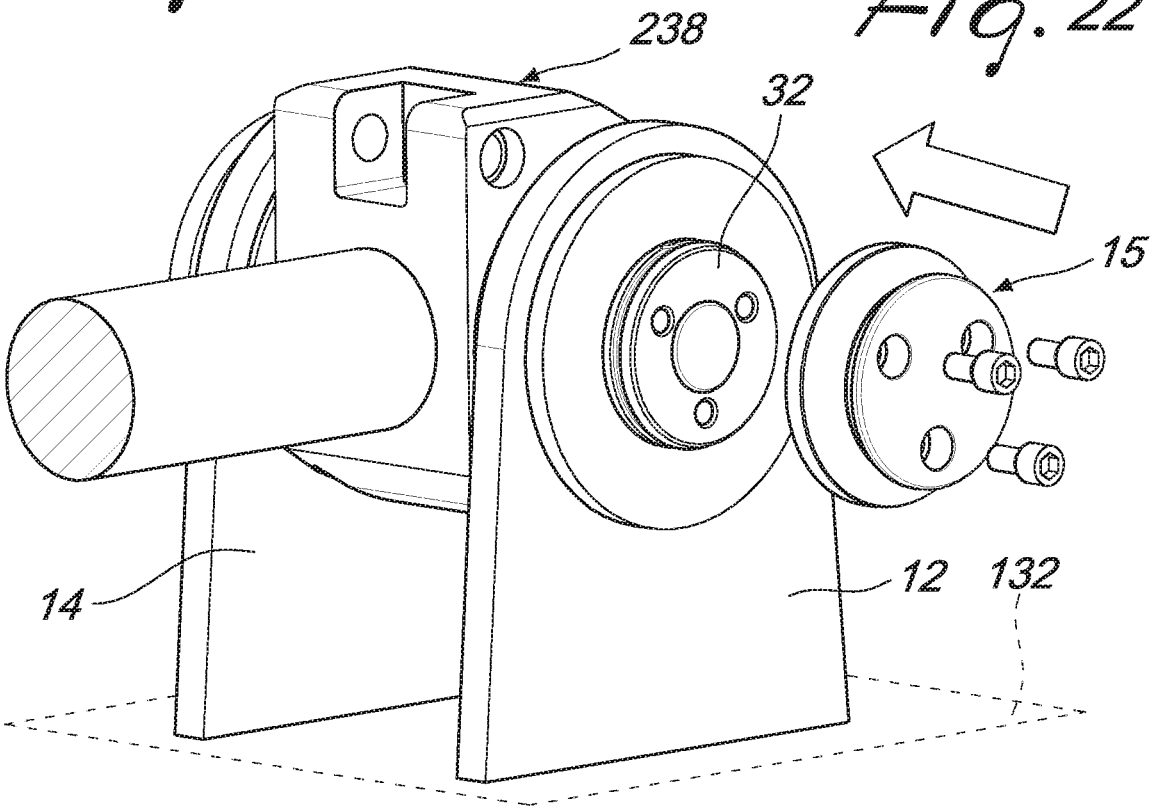

METHOD OF DECOUPLING A CYLINDER FROM A JAW IN A DEMOLITION TOOL AND LINK ASSEMBLY THEREOF

CLAIM FOR PRIORITY

This application is a U.S. National Phase entry under 35 U.S.C. § 371 from PCT International Application No. PCT/EP2015/064434, filed Jun. 25, 2015, which claims benefit of priority of European Patent Application No. 14174769.1, filed Jun. 27, 2014, all of which are incorporated herein by reference.

TECHNICAL FIELD

This disclosure relates to the field of demolition tools for crushing and/or cutting material and more particularly to the field of replacing working parts in demolition tools.

BACKGROUND

A demolition tool for crushing and/or cutting material is generally known. Typically, the demolition tool may comprise a jaw assembly having a lower jaw and an upper jaw. The upper and lower jaws may be pivotally connected. The upper and lower jaws may be moveable relative to each other. Blades may be provided on both the upper jaw and the lower jaw. The work material may be crushed or cut by closing the upper jaw and the lower jaw under hydraulic pressure.

The demolition tool may have a jaw assembly that is suitable for crushing concrete. The jaw assembly may be adapted for crushing or cutting other materials, for example for cutting scrap iron and/or iron sections. The abrasive nature or hardness of some of these materials may cause wear of the surfaces that engage the materials and moving parts that impart force to the jaw assembly, such as hydraulic cylinders.

The demolition tool may be provided with replaceable cylinders. The cylinders may be connected directly to the jaw assembly by conventional techniques. The cylinders may be connected to the upper or the lower jaw.

The present disclosure is directed, at least in part, to improving or overcoming one or more aspects of the prior art system.

BRIEF SUMMARY OF THE INVENTION

In a first aspect, the present disclosure describes a method of decoupling a cylinder from a jaw in a demolition tool. The method may comprise the steps of: unlocking a first end of a pin from a first lug wherein the pin has a groove adjacent the first end, the groove being in a plane substantially transverse to the longitudinal axis of the pin; rotating first and second lugs in a first direction from a first lug position to a second lug position wherein the pin slides through the first and second lugs and the first end moves from the first lug to the second lug to uncouple the cylinder from the jaw; engaging a locking element biasingly supported on the second lug into the groove to retain the pin at the second lug; and moving the cylinder from between the spaced apart first and second lugs.

In a second aspect, the present disclosure describes a link assembly for decoupling a cylinder from a jaw in a demolition tool. The link assembly may comprise: a first lug having a first bore and a second lug having a second bore, the first and second lugs being spaced apart; a pin having a groove adjacent a first end, the groove being in a plane substantially orthogonal to a longitudinal axis wherein the pin is movable through the first and second bores; a lock mechanism to lock the first end to the first lug; and a locking element biasingly supported on the second lug for engaging into the groove to retain the pin at the second lug.

BRIEF DESCRIPTION OF THE DRAWINGS

The foregoing and other features and advantages of the present disclosure will be more fully understood from the following description of various embodiments, when read together with the accompanying drawings, in which:

FIGS. 10 to 22 illustrate a method of decoupling a cylinder from a jaw in a demolition tool.

DETAILED DESCRIPTION

Figure 1:
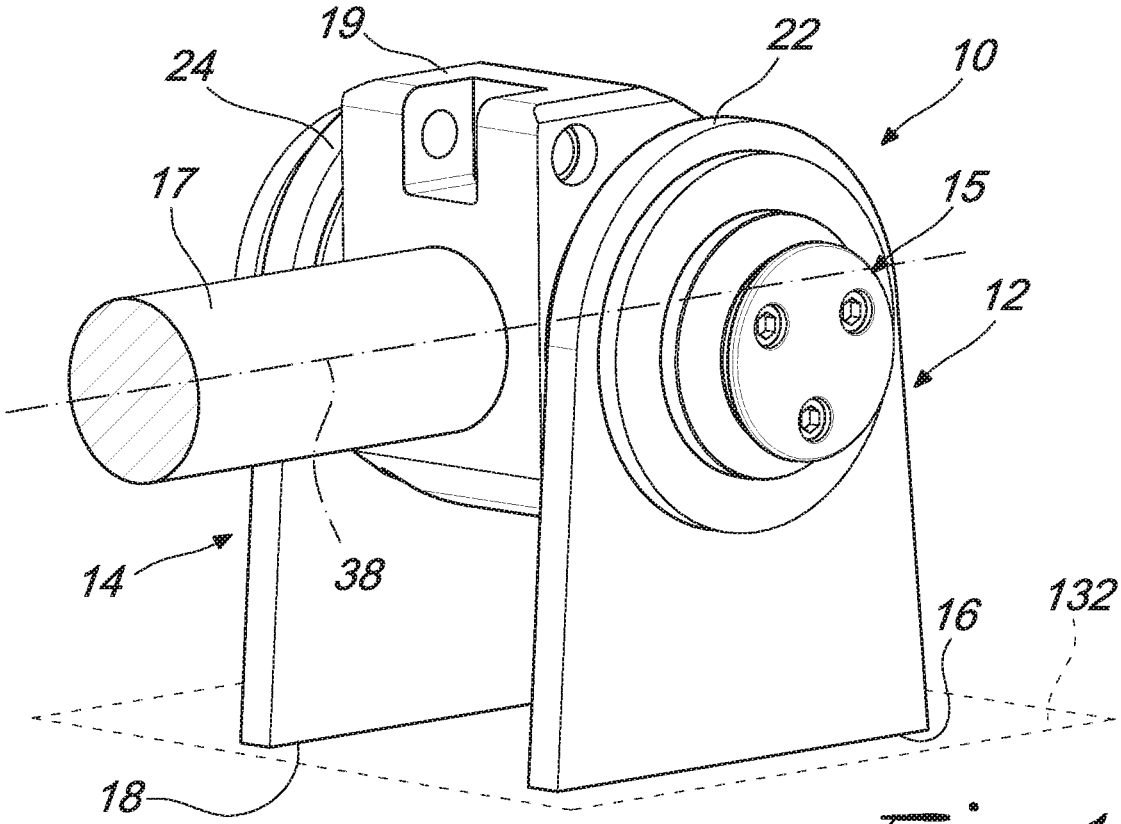
FIG. 1 is an isometric view of a link assembly coupled to a piston rod head according to the present disclosure.

This disclosure generally relates to a link assembly for decoupling a cylinder in demolition tool. FIG. 1 illustrates the link assembly 10. The link assembly 10 may have a pair of lugs 12, 14, a pin (not shown), a lock mechanism 15 and a lock element (not shown). A piston rod 17 of a hydraulic cylinder (not shown) may be coupled to the link assembly 10 through a piston rod head 19.

The first lug 12 may be spaced from the second lug 14. The first and second lugs 12, 14 may each have a respective fixed end 16, 18. The first and second lugs 12, 14 may each be supported at the respective fixed ends 16, 18. The first and second lugs 12, 14 may each be supported on a jaw (not shown) at the respective fixed ends 16, 18. The jaw may be a lower jaw or an upper jaw of a jaw set (not shown). First and second lugs 12, 14 may be orthogonal to the surface of the jaw.

First and second lugs 12, 14 may be cantilevered structures. First and second lugs 12, 14 may extend from the surface of the jaw such that respective free ends 22, 24 are positioned away from the jaw. First and second lugs 12, 14 may be mutually parallel. First and second lugs 12, 14 may be positioned so as to have surfaces that face each other. First and second lugs 12, 14 may be positioned so as to be mutually aligned. First and second lugs 12, 14 may be plate like. The first and second lugs 12, 14 may have bushings at the first and second bores 26, 28. Bushings may extend through the first and second bores 26, 28.

Figure 2:
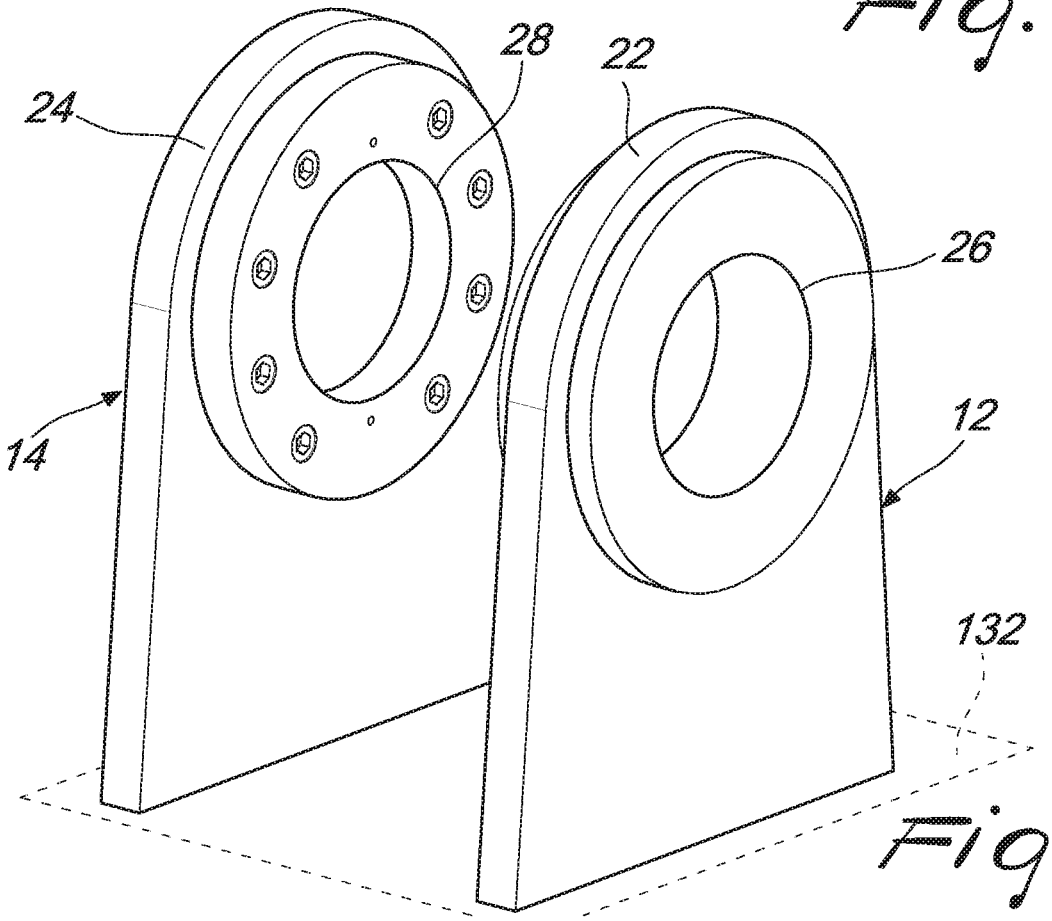
FIG. 2 is an isometric view of a pair of lugs of the link assembly of FIG. 1.

With respect to FIG. 2, each of the first and second lugs 12, 14 may have first and second bores 26, 28. Bores 26, 28 may extend through the first and second lugs 12, 14. The first and second bores 26, 28 may be spaced apart. The first and second bores 26, 28 may be mutually aligned. First and second bores 26, 28 may be equidistant from the respective fixed ends 16, 18 and the respective free ends 22, 24. First and second bores 26, 28 may have the same dimensions. Each first and second bore 26, 28 may be in a respective vertical plane that are mutually parallel. The respective vertical planes may be orthogonal to the surface of the jaw (not shown).

Figure 3:
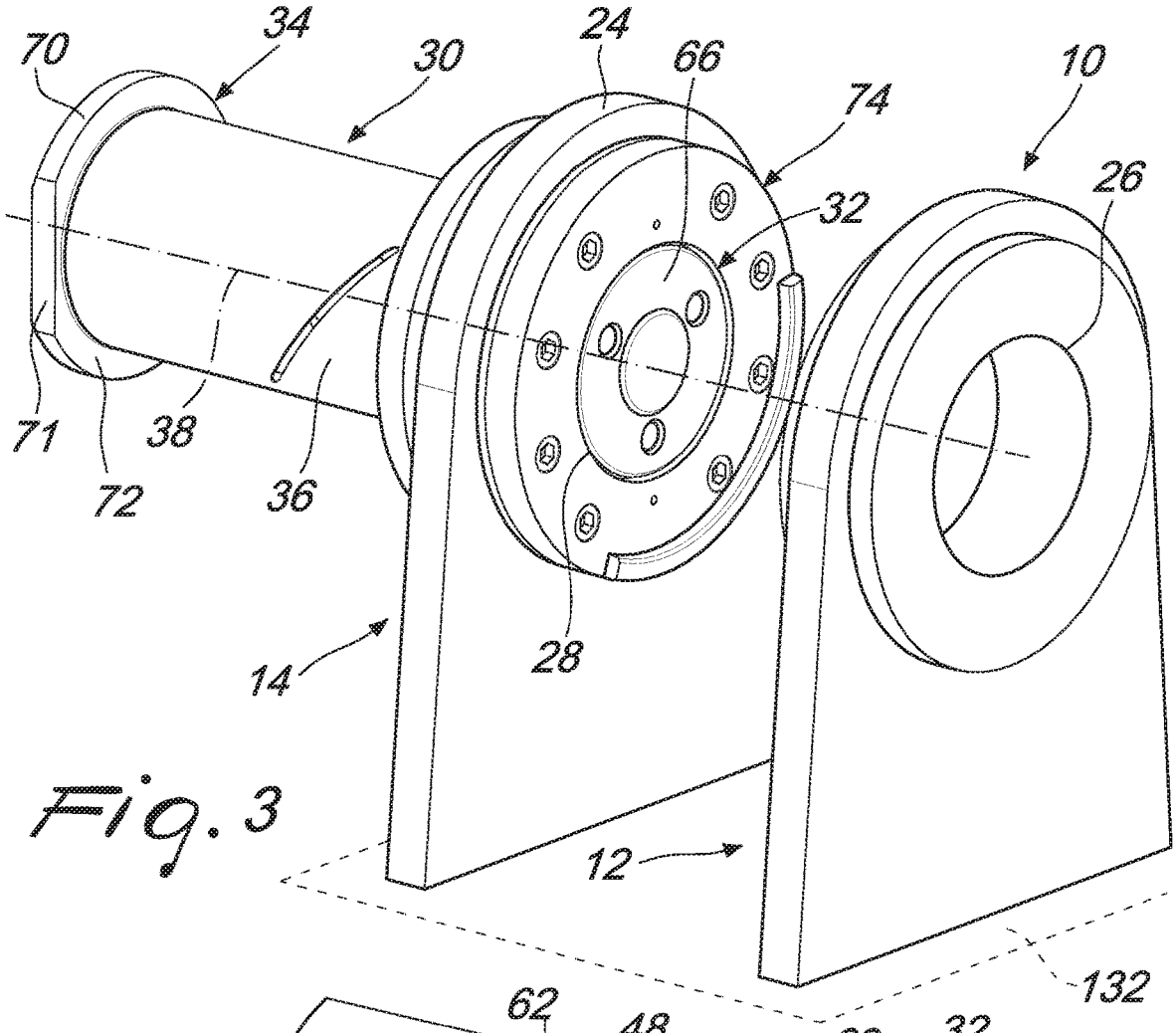
FIG. 3 is an isometric view of a link assembly according to the present disclosure.

With reference to FIG. 3, the pin 30 may be movable relative to the first and second lugs 12, 14. Pin 30 may be movable relative to the jaw (not shown). The pin 30 may be movable through the first and second bores 26, 28. The pin 30 may be movably supported by the first lug 12 and/or second lug 14 at the respective first bore 26 and/or second bore 28. The pin 30 may be movable at the first and/or second bores 26, 28. The pin 30 may be movable through the bushings at the first and/or second bores 26, 28.

The pin 30 may be slidably supported by the first lug 12 and/or second lug 14 at the respective first bore 26 and/or second bore 28. The pin 30 may be slidable through the first and/or second bores 26, 28. The pin 30 may be slidable through the bushings at the first and/or second bores 26, 28.

Pin 30 may be rotatably supported by the first lug 12 and/or second lug 14 at the respective first bore 26 and/or second bore 28. The pin 30 may be rotatable in the first and/or second bores 26, 28. The pin 30 may be rotatable at the bushings at the first and/or second bores 26, 28.

Pin 30 may have a longitudinally extended body 36. Body 36 may be formed as a rod. Pin 30 may have a first end 32 and a second end 34 at opposite ends of the body 36. Pin 30 may have a longitudinal axis 38 extending through the body 36. Pin 30 may be rotatable about the longitudinal axis 38. Body 36 may be sized to fit in the first and second bores 26, 28. Body 36 may be sized to fit in the bushings at the first and second bores 26, 28. In an embodiment, the pin 30 may have an outside diameter of 125 mm.

Figure 4:
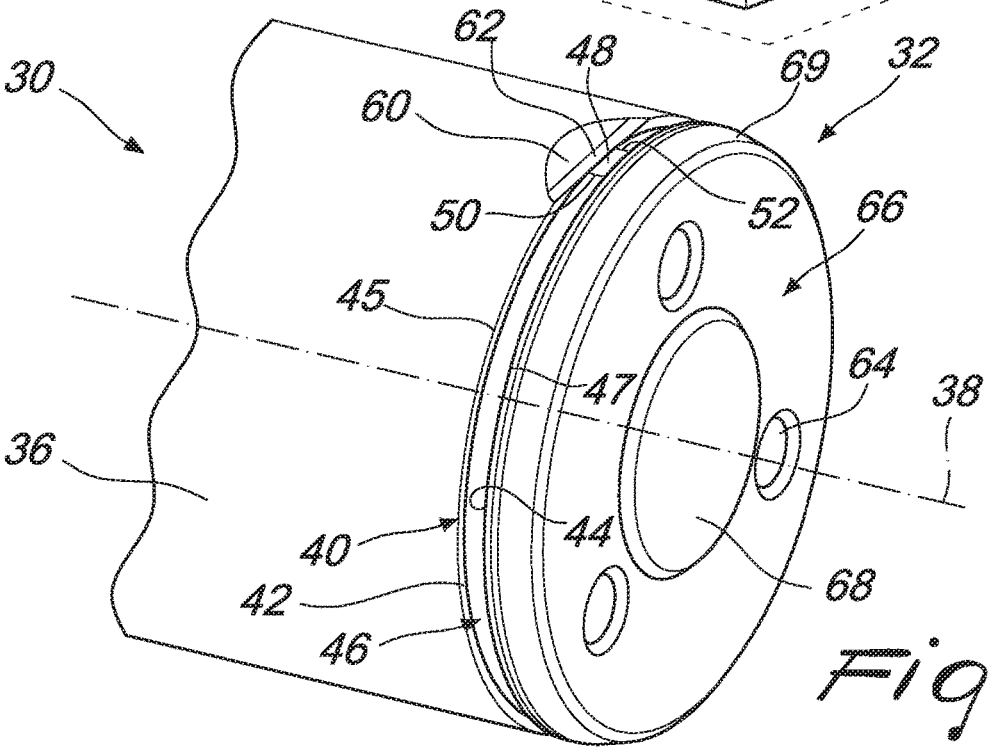
FIG. 4 is an isometric view of a portion of a pin of the link assembly of FIG. 3.

With reference to FIG. 4, the pin 30 may have a groove 40 at the first end 32. Groove 40 may be adjacent the first end 32. Groove 40 may encircle the body 36. In an embodiment, groove 40 may partially encircle body 36. The groove 40 may be in a plane that is substantially orthogonal to the longitudinal axis 38 of the pin 30. The groove 40 may be in a plane that is substantially transverse to body 36.

Groove 40 may extend into body 36. Groove 40 may extend in a direction transverse to the longitudinal axis 38. In an embodiment, groove 40 may extend radially into body 36. Groove 40 may have side walls 42, 44 and a floor 46. Side walls 42, 44 may be mutually parallel. Side walls 42, 44 may be orthogonal to the longitudinal axis 38. Side walls 42, 44 may extend substantially transverse to the body 36. Side wall 42 may be closer to the first end relative to the side wall 42. Floor 46 may be normal to the side walls 42, 44. Floor 46 may lie on a plane that is parallel to the longitudinal axis 38. Floor 46 may be curved. Floor 46 may connect side walls 42, 44. Groove 40 may have edges 45 and 47 at surface 36 of the pin 30.

Groove 40 may have a width of 6 mm. The distance between the side walls 42, 44 may be 6 mm. Groove 40 may have a diameter of 120 mm. The diameter of the groove may be measured from a portion of floor 46 portion to an opposite portion of floor 46 across the centre of the pin 30.

Groove 40 may have a depth that is measured from floor 46 to the surface of body 36. Groove 40 may have a depth that is measured from floor 46 to the edge 47 of the side wall 44. The magnitude of depth may vary along the groove 40. The magnitude of depth may vary uniformly along the groove 40. The magnitude of depth may vary about the longitudinal axis 38. In an embodiment, the magnitude of depth may have plurality of variations about the longitudinal axis 38. The depth of the groove 40 from the edge 47 to the floor 46 may be 2.5 mm.

The groove 40 may have at least one platform 48. Platform 48 may be a portion of the floor 46. Platform 48 may be a lowered portion of the floor 46. The magnitude of the depth of the groove 40 may be highest at the platform 48 relative to the rest of the groove 40. The magnitude of the depth of the groove 40 may be uniform across the platform 48. Platform 48 may be the lowest portion of the groove 40 relative to the portion of the floor 46 along the rest of the groove 40. The distance from the edge 47 to the platform 48 may be 2.75 mm. Platform 48 may have a radial distance of 59.75 mm from the centre of the pin 30.

The platform 48 may be spaced from the edge 47 of the side wall 44. The platform 48 may be spaced from a portion of the edge 47. Platform 48 may be spaced from the edge 47 radially adjacent thereto. The side of platform 48 opposite side wall 44 may not have a side wall 42.

Platform 48 may have a first free side 50 and a second free side 52. The first and second free sides 50, 52 may not be adjoined to the side walls 42, 44. The first and second free sides 50, 52 may be adjacent the side wall 44.

In an embodiment, a plurality of platforms 48 may be provided in the groove 40. The magnitude of depth at each platform 48 may be the same. The magnitude of the depth of the groove 40 may be highest at each platform 48 relative to the rest of the groove 40. Each platform 48 may be the lowest portions of the groove 40 relative to the portions of the floor 46 along the rest of the groove 40. The plurality of platforms 48 may be interspersed in the floor 46. Side wall 42 may be absent at each platform 48.

In an embodiment, the groove 40 may have at least two platforms 48 located at opposite points of the groove 40. The platforms 48 may have an angular separation of 180 degrees in the groove 40. The platforms 48 may have an angular separation of 180 degrees about the longitudinal axis 38. Two sections of floor 46 may be interposed between the platforms 48.

In a further embodiment, the groove 40 may have at least four platforms 48. The platforms 48 may have an angular separation of 90 degrees in the groove 40. The platforms 48 may have an angular separation of 90 degrees about the longitudinal axis 38. Four sections of floor 46 may be interposed between the platforms 48.

With reference to FIG. 4, the pin 30 may further comprise a tapered portion 60. Tapered portion 60 may be adjacent to the groove 40. Tapered portion 60 may have a surface that increases in inclination towards the groove 40. The tapered portion 60 may be bound by the surface of the body 36 at the side opposite the groove 40. Tapered portion 60 may be contiguous with the surface of the body 36. Tapered portion 60 may have an angle of inclination of 15 degrees.

The pin 30 may further comprise a flattened portion 62 interposed between the tapered portion 60 and the groove 40. An edge of the flattened portion 62 adjacent tapered portion 60 may be contiguous with tapered portion 60 and groove 40. Flattened portion 62 may be contiguous with edge 45.

Figure 5:
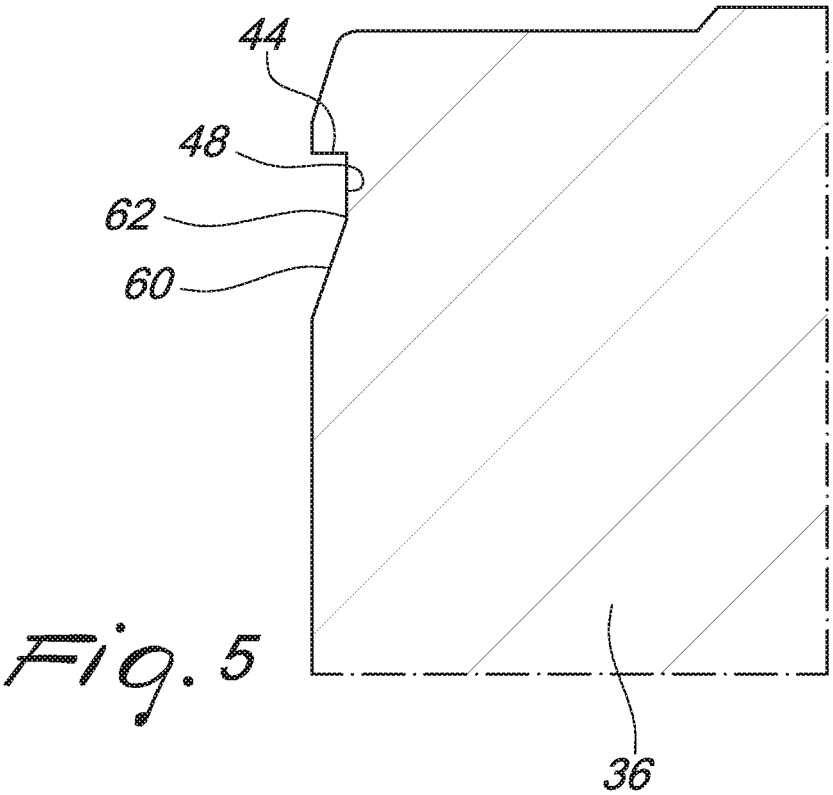
FIG. 5 is a sectional view through the portion of the pin of FIG. 4.

With reference to FIG. 5, the tapered portion 60 may be inclined from the surface of the body 36 towards the platform 48 in groove 40. Flattened portion 62 may be level with platform 48. Flattened portion 62 may be replace side wall 42.

With reference to FIG. 4, the first end 32 may be configured for coupling to a lock mechanism (not shown). The first end 32 may be provided with bolt holes 64 for coupling the lock mechanism by bolts. The bolt holes 64 may be radially distributed on an abutment face 66 at the first end 32. Bolt holes 64 may extend into the body 36 from the abutment face 66 in a direction parallel to the longitudinal axis 38.

A raised portion 68 may be positioned in the centre of the abutment face 66. The bolt holes 64 may be radially distributed around the raised portion 68. Raised portion 68 may extend from the abutment face 66 in a direction parallel to the longitudinal axis 38. Raised portion 68 may be positioned such that the longitudinal axis 38 may intersect the centre thereof. Raised portion 68 may be not be covered. Raised portion 68 may be provided for impact from a tool to move the pin 30 in the event of any frictional blockages preventing the movement of the pin 30.

The first end 32 may have a bevelled edge 69. The bevelled edge 69 may encircle the first end 32. Bevelled edge 69 may be adjacent to the groove 40. Bevelled edge 69 may be located between the groove 40 and the abutment face 66.

Figure 6:
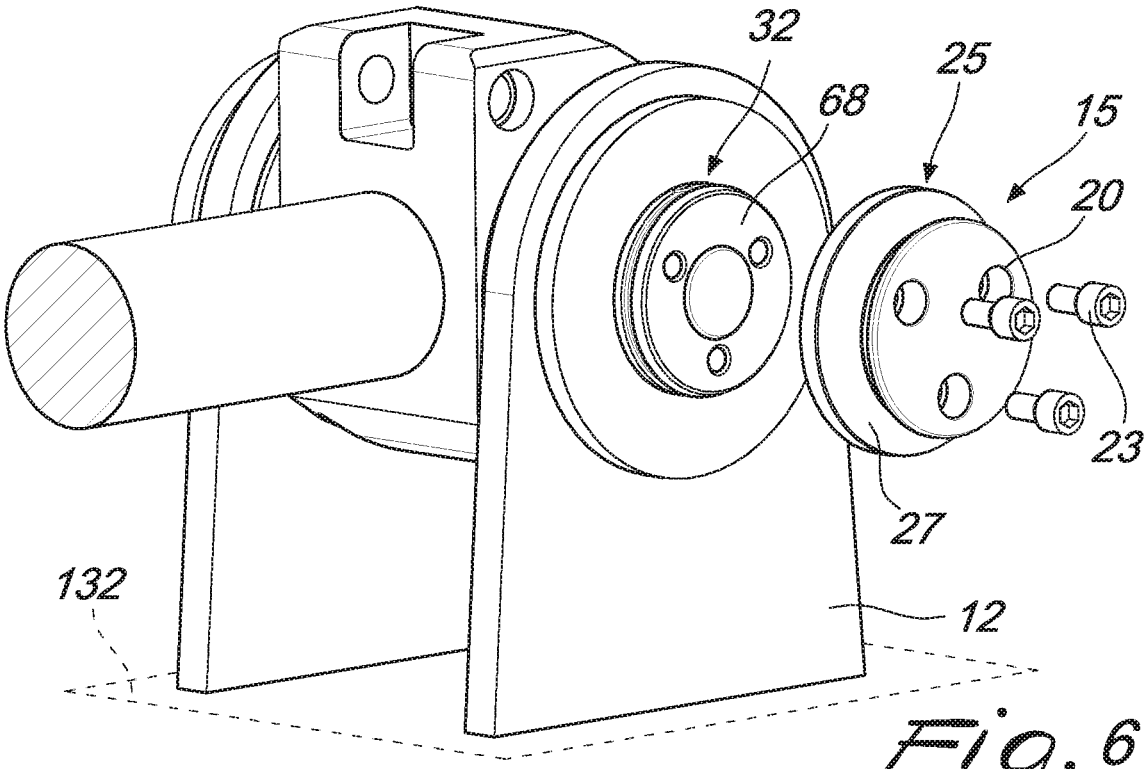
FIG. 6 is an exploded view of lock mechanism of the link assembly of FIG. 1.

In an alternative embodiment, the first end 32 may be provided with a through hole (not shown) extending laterally through body 36 for receiving a pin (not shown). In a further alternative embodiment, a threaded pin may be provided to engage a lock with nut. In yet another embodiment, the lock mechanism 15 may be provided at the other end of the pin 30 with a projection thereon that can be secured with a bolt to the second lug 14. With reference to FIG. 6, the lock mechanism 15 may lock the first end 32 of the pin 30 to the first lug 12. The lock mechanism 15 may comprise a housing 25. Holes 20 may be formed on the housing 25 to receive bolts 23 for engaging the first end 32. The housing 25 may be orientated to register the holes 20 with the bolt holes 64 on the first end 32. The bolts 23 may be inserted through the holes 20 and the bolt holes 64 to engage the housing 25 to the first end 32. Housing 25 may have an abutment portion 27 for abutting the first lug 12 or the bushing at the first bore 26. With the housing engaged to the first end 32 the abutment portion 27 may abut the first lug 12 or the bushing at the first bore 26 thereby locking the first end 32 to the first lug 12. The lock mechanism 15 may protect the end of pin 30 having the groove 40 and the pin length from groove 40 till the first end 32.

With reference to FIG. 3, at the second end 34, the pin 30 may have a limit plate 70. Limit plate 70 may be in a plane that is normal to the longitudinal axis 38. Limit plate 70 may be in a plane that is parallel to the abutment face 66. Limit plate 70 may be positioned such that the longitudinal axis 38 may intersect the centre thereof. Limit plate 70 may have a shoulder 72. Shoulder 72 may limit the movement of the pin 30 through the first and second lugs 12, 14. Shoulder 72 may abut the second lug 14. Shoulder 72 may abut the bushing through the second bore 28. Limit plate 70 may have at least one planar portion 71. The planar portion 71 may be orthogonal to the shoulder 72. Limit plate 70 may have at least two planar portions 71. The number of the planar portions 71 may correspond to the number of platforms 48. The limit plate 70 may have at least one planar portion 71 aligned to the position of the platform 48. The limit plate 70 may comprises a plurality of planar portions 71 each being aligned to the positions of a plurality of platforms 48.

Figure 17:
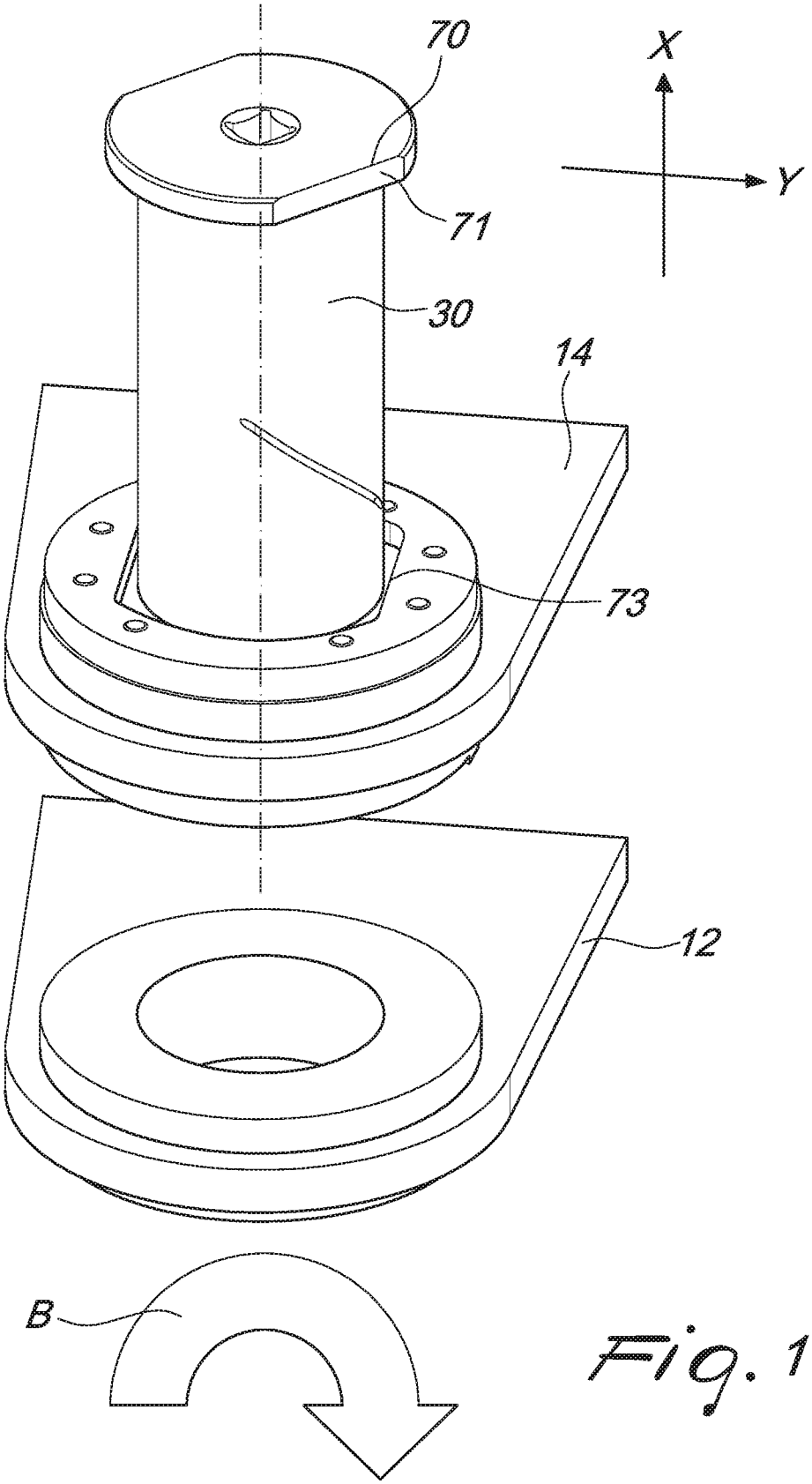

Bushing (not shown) on the second lug 14 may have an aperture so as to receive the limit plate 70. The aperture 73 may be sized and shaped to receive the limit plate 70. FIG. 17 illustrates the aperture 73 into which the limit plate 70 may fit.

With reference to FIG. 3, a catch plate 74 may be positioned on the second lug 14. Catch plate 74 may be positioned between the first lug 12 and the second lug 14. Catch plate 74 may be positioned on the side of the second lug 14 that faces the first lug 12. Catch plate 74 may be positioned adjacent the free end 24. Catch plate 74 may be positioned around second bore 28. Catch plate 74 may be positioned on the bushing of the second bore 28.

Figure 7:
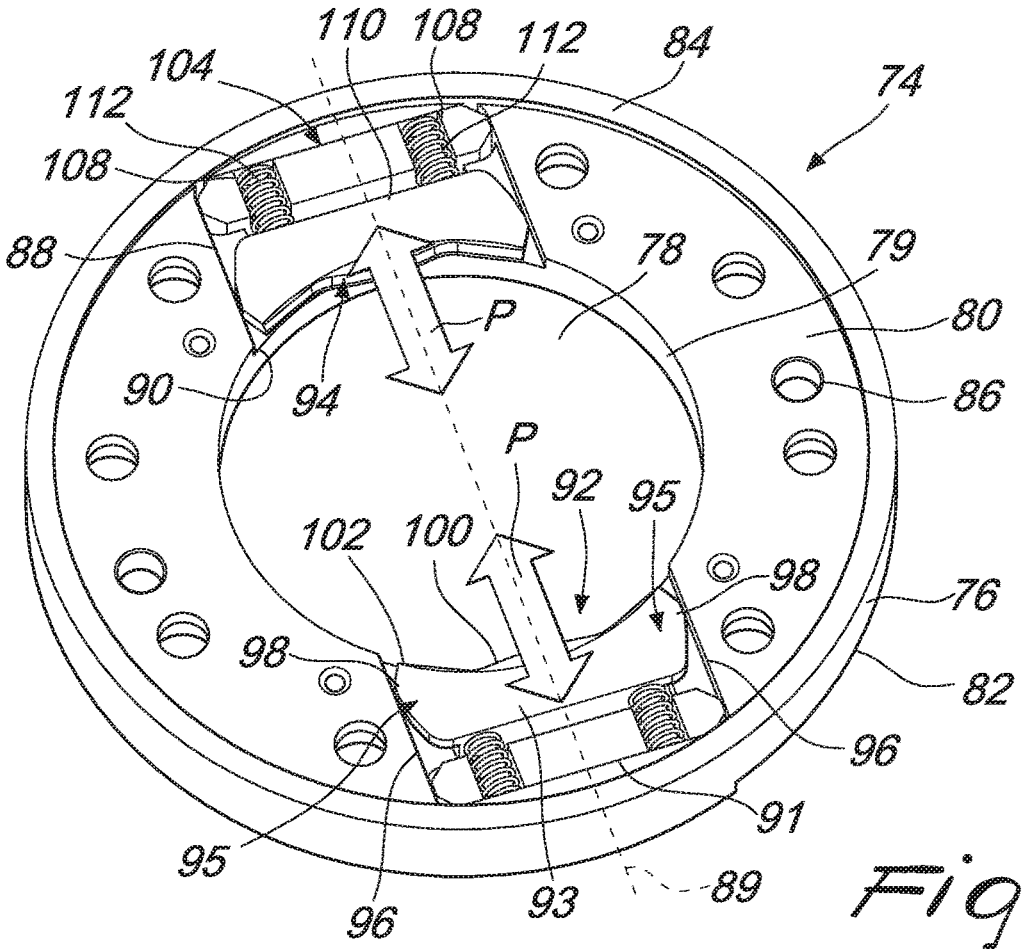
FIG. 7 is an isometric view of a catch plate of the link assembly of FIG. 3.

With reference to FIG. 7, the catch plate 74 may have a body 76. Body 76 may have a central aperture 78. Central aperture 78 may extend through the body 76. Central aperture 78 may have the same dimension as the second bore 28 of the second lug 14. Central aperture 78 may be sized and shaped to receive body 36 of the pin 30. Central aperture 78 may be defined by an inner edge 79 of the body 76. Body 76 may have bolt holes 86 for engaging to the second lug 14 or the bushing of the second bore 28.

Body 76 may have a first side 80 and a second side 82. First side 80 may face the second lug 14 and second side 82 may face the first lug 12 when the catch plate 74 is positioned on the second lug 14. In an embodiment, body 76 may be disc shaped.

Catch plate 74 may have a band 84 on body 76. Band 84 may encircle first side 80. Band 84 may be perpendicular to the first side 80. Band 84 may be formed along the circumference of the first side 80. Band 84 may be concentric with the inner edge 79. First side 80 may be bordered by the central aperture 78 and the band 84. Band 84 may contact the surface of the second lug 14 or the bushing of the second bore 28 when the catch plate 74 is positioned on the second lug 14.

Catch plate 74 may have at least on slot 88. Slot 88 may be provided in the body 76. Slot 88 may have side walls 96 and an end wall 91. Side walls 96 may extend from the inner edge 79 to the end wall 91. Slot 88 may be a depression in the body 76. Slot 88 may be provided on the first side 80. Slot 88 may be adjacent to central aperture 78. Slot 88 may extend from the inner edge 79 towards the band 84. Slot 88 may extend linearly from the central aperture 78 to the band 84. Slot 88 may extend radially from the central aperture 78 towards the band 84. Slot 88 may have a central axis 89. Central axis 89 may extend radially through the centre of body 76.

Slot 88 may have an opening 90 in communication with the central aperture 78. Opening 90 may be formed in the inner edge 79. Opening 90 may be located opposite the end wall 91. Opening 90 may be bordered at opposite ends by side walls 96. Opening 90 may be positioned adjacent the first side 80. Opening 90 may be elevated with respect to the floor (not shown) of the slot 88. Opening 90 may be in a plane that is substantially orthogonal to the central axis 89.

In an embodiment, the catch plate 74 may have a plurality of slots 88. Slots 88 may be positioned radially on body 76. The catch plate 74 may have at least two slots 88 located at opposite points of the first side 80. The slots 88 may have an angular separation of 180 degrees about the central aperture 78. In a further embodiment, the catch plate 74 may have at least four slots 88. The slots 88 may have an angular separation of 90 degrees about the centre aperture 78.

Catch plate 74 may have a locking element 92. Locking element 92 may move relative to the body 76. Locking element 92 may be supported in the slot 88. Locking element 92 may be stowed in the slot 88. Locking element 92 may be movable in the slot 88. Locking element 92 may be movable along a path P that is substantially parallel to the central axis 89.

Locking element 92 may be movable from the stowed position in the slot 88 into the central aperture 78. Locking element 92 may be in a locked position in the central aperture 78. Locking element 92 may move into the central aperture through the opening 90. The locking element 92 may be movable in a linear path from the stowed position into the central aperture 78.

Locking element 92 may be guided from the stowed position to move into the central aperture 78 by the slot 88. Side walls 96 of the slot 88 may guide the locking element 92 to move between the stowed positions and the locked positions. In an embodiment, side walls 96 may be parallel and may extend linearly from the inner edge 79 to the end wall 91. Locking element 92 may move axially in the slot 88 between the stowed positions and the locked positions. Locking element 92 may move radially relative to the body 76 between the stowed positions and the locked positions.

Locking element 92 may have a body 93 that extends laterally across the slot 88. Locking element 92 may have contact sides 95. Contact sides 95 may be on opposite parts of the locking element 92. Contact sides 95 may face the side walls 96 of the slot 88. Contact sides 95 of the locking element 92 may contact the side walls 96. Contact sides 95 may be guided by the side walls 96 for linear movement of the locking element 92 between the stowed position and the locked position. Contact sides 95 may be in constant contact with the side walls 96 between the stowed position and the locked position.

Contact edges 98 may extend laterally from the contact sides 95. Contact edges 98 of the locking element 92 may contact the side walls 96. Contact edges 98 may be guided by the side walls 96 for linear movement of the locking element 92 between the stowed position and the locked position. Contact edges 98 may be in constant contact with the side walls 96 between the stowed position and the locked position. Contact edges 98 may have small contact areas that contact the side walls. Contact edges 98 may be in the form of truncated protrusion. Contact edges 98 may be formed so as to avoid being obstructed by side walls 96 if the locking element 92 moves in a non linear path between the stowed position and the central aperture 78. In an alternative embodiment, the locking element 92 may be movable in an arcuate path from the stowed position into the central aperture 78. The locking element 92 may be pivotably hinged in the slot 88. The locking element 92 may be pivotable about the hinge so as to rotate from stowed position in the slot 88 to the locked position in the central aperture 78.

Locking element 92 may have a lock side 94. Lock side 94 may extend between the contact sides 95. Lock side 94 may be orientated to face the opening 90. Lock side 94 may move through the opening 90 into the central aperture 78. Lock side 94 may engage into the groove 40 of the pin 30. Lock side 94 may be sized and shaped to engage into the groove 40. Lock side 94 may be configured to move in the groove 40. Lock side 94 may contact the body 36 of the pin 30. Lock side 94 may be configured to slide along the surface of body 36.

Lock side 94 may be curved with a centrally located protrusion 100. Ends 102 on opposite sides of the protrusion 100 may extend further from the body 93 of the locking element 92 than the protrusion 100. Protrusion 100 may be configured to contact platform 48, and the floor 46.

Locking element 92 may have a biasing side 110. Biasing side 110 may be subject to a biasing force. Biasing side 110 may be substantially orthogonal to the central axis 89. Biasing side 110 may extend between the contact sides 95. Biasing side 110 may be orientated to face away from the opening 90. Biasing side 110 may be formed opposite the lock side 94.

In an embodiment, the catch plate 74 may have a plurality of locking elements 92 each positioned in a respective slot 88. The catch plate 74 may have at least two locking elements 92. In a further embodiment, the catch plate 74 may have at least four locking elements 92.

Catch plate 74 may comprise a support element 104. The support element 104 may be located in the slot 88. Support element 104 may extend transversely across the slot 88. The support element 104 may be positioned adjacent the end wall 91 of the slot 88. Support element 104 may be positioned between the end wall 91 and the biasing side 110 of the locking element 92. Support element 104 may be retained in the slot 88 at the end wall 91. Support element 104 may have a longitudinal axis that is substantially orthogonal to the central axis 89.

Support element 104 may have at least one duct 108. Duct 108 may extend transversely across the support element 104. Duct 108 may be substantially parallel to the central axis 89. Duct 108 may extend to the end wall 91. Duct 108 may be substantially parallel to the side walls 96 of the slot 88. Duct 108 may be substantially orthogonal to the biasing side 110. Rod 109 may be sized and shaped to fit into the duct 108.

Duct 108 may be shaped and sized to retain a biasing element 112. The biasing element 112 may extend from the duct 108 in a direction away from the band 84 into the slot 88. The biasing element 112 may extend in a direction parallel to central axis 89. Biasing element 112 may be interposed between the end wall 91 and the biasing side 110. Biasing element 112 may contact the end wall 91 at an end and the biasing side 110 at an opposite end. Biasing element 112 may be under tension when positioned in the duct 108 between the locking element 92 and the housing 76.

Locking element 92 may be coupled to the biasing element 112. In an embodiment, the biasing element 112 may be a spring. The spring may be a helical spring. Rod 109 may be sized and shaped to fit into the centre of the helical spring. The biasing element 112 may exert a biasing force in a direction substantially parallel to the central axis 89. Biasing element 112 may exert a biasing force on the biasing side 110 of the locking element 92. Biasing element 112 may urge the locking element 92 to move from the stowed position to the locked position. Biasing element 112 may urge the locking element 92 to move into the central aperture 78. Biasing element 112 may urge the locking element 92 against the pin 30.

In an embodiment, support element 104 may have two ducts 108 positioned adjacent the opposite ends thereof. Each duct 108 may be provided with a biasing element 112.

Figure 8:
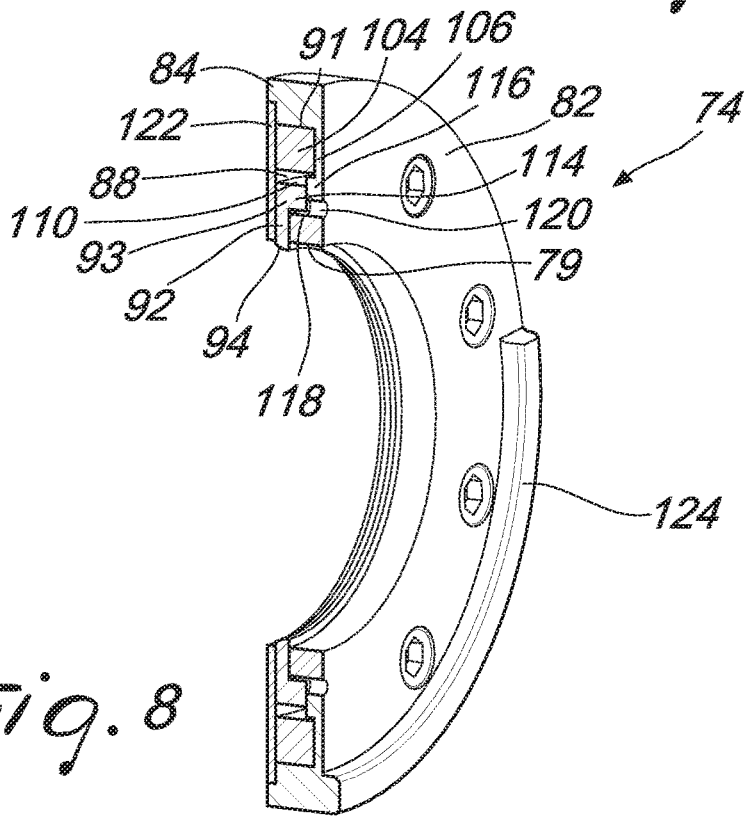
FIG. 8 is a sectional view through a portion of the catch plate of FIG. 7.

With reference to FIG. 8, the locking element 92 may have a flange 114 extending transversely from body 93. Flange 114 may be substantially orthogonal to body 93. Flange 93 may be positioned at the biasing side 110. A side flange 114 may be contiguous with biasing side 110. Biasing side 110 may be continuous with a side of flange 114. Flange 114 may extend towards the slot floor 116.

Flange 114 may move between the support element 104 and an abutting surface 118. Abutting surface 118 may be formed on the wall of the inner edge 79. Abutting surface 118 may be opposite the inner edge 79. The extent of movement of the locking element 92 between the stowed position in the slot 88 and the locked position in the central aperture 78 may be determined by the movement of the flange 114 between the support element 104 and the abutting surface 118. Support element 104 may determine limit of the locking element 92 in the stowed position and the abutting surface 118 may determine the limit of the locking element 92 in the locked position.

A cut out 106 may be formed in the slot floor 116. The cut out 106 may be located towards the band 84 and away from the opening 90. Cut out 106 may be positioned transversely across the slot 88. Support element 104 may be seated in the cut out 106 at the end wall 91.

Catch plate 74 may have an access 120 that extends from the second side 82 through the body 76 to the slot floor 116. The access 120 has an aperture adjacent the abutting surface 118. Insertion of a blocking element (not shown) such as a pin may serve to prevent the flange 114 from moving into contact with the abutting surface 118. The locking element 92 may be prevented from moving to the locked position through insertion the insertion of the blocking element.

A cover plate 122 may be positioned over the first side 80 of the body 76. Cover plate 122 may have a thickness that is the same as the height as the band 84. Cover plate 122 may be interposed between the first side 80 and the second lug 14. Cover 122 may be in contact with the second lug 14. Cover plate 122 may be interposed between the first side 80 and the bushing of the second bore 28. Cover plate 122 may be centred on the first side 80 by the band 84. Cover 122 may retain the biasing element 122.

Catch plate 74 may have an alignment edge 124 projecting transversely from the body 76. Alignment edge 124 may extend from the second side 82. Alignment edge 124 may extend along the circumference of the second side 82. Alignment edge 124 may extend through an angle of 90 degrees about the central aperture 78.

The alignment edge 124 may enable alignment of a cylinder (not shown) with the link assembly 10. The alignment edge 124 may receive the piston rod head 19. The alignment edge 124 may enable alignment of the coupling hole in the piston rod head 19 and the first and second bores 26, 28 of the link assembly 10.

Figure 9:
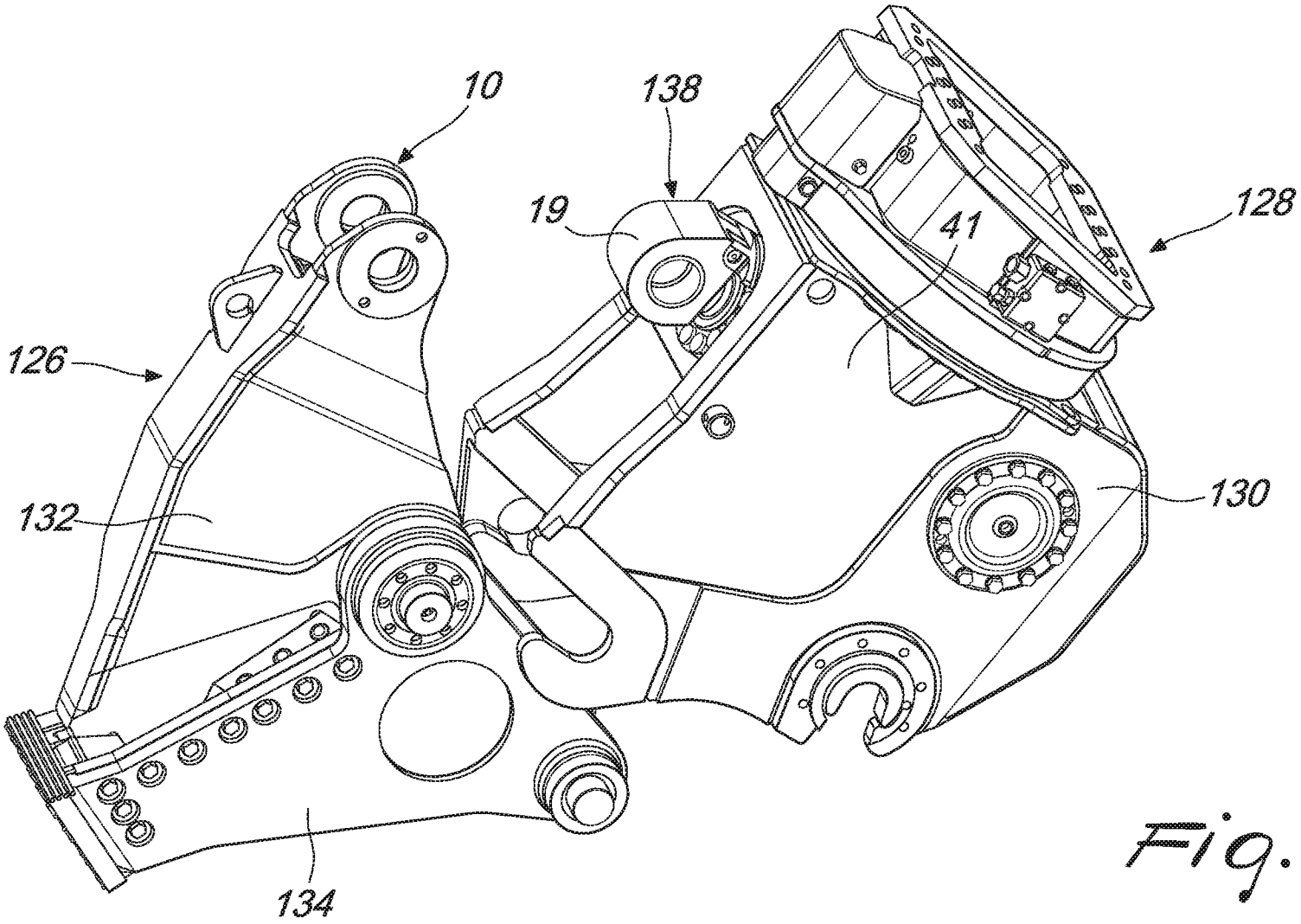
FIG. 9 is a perspective view of a demolition tool with the link assembly of FIG. 3 on a jaw of the demolition tool.

With reference to FIG. 9, the link assembly 10 may be provided on a jaw set 126 of a demolition tool 128. The demolition tool 128 may comprise a frame 130 and the jaw set 126. The jaw set 126 may comprise a first jaw 132 and a second jaw 134 coupled to the frame 130. The link assembly 10 may be formed on the first or second jaw 132, 134. The cylinder 138 may be positioned in the frame 130. The piston rod head 19 of the cylinder 138 may extend from the frame 130 for coupling to the link assembly 10.

In the link assembly 10 the locking element 92 may be supported on the second lug 14 for engaging into the groove 40 to retain the pin 30 at the second lug 14. The locking element 92 may be urged from the stowed position to the locked position to engage in groove 40. The pin 30 may be rotatable relative to the second lug 14 such that the locking element 92 is movable along the groove 40 between a first groove position and a second groove position.

The platform 48 may be at the first groove position. The first groove position may be limited by a single side wall 44. The second groove position may be any point on the floor having both the side walls 42, 44. The second groove position may limited by two side walls 42, 44. In an embodiment, the groove 40 may have a platform 48 at the first groove position where there is an absence of side wall 42 which may prevent axial movement in one direction and may permit axial movement in the opposite direction. Axial movement may be prevented at the second groove position where both the side walls 42, 44 are present.

A method of decoupling a cylinder 138 with a jaw 132 in a demolition tool 128, the jaw 132 having spaced apart first and second lugs. The method comprising the steps of unlocking a first end 32 of a pin 30 from a first lug 12 wherein the pin 30 has a groove 30 adjacent the first end 32, the groove 40 being in a plane substantially transverse to the longitudinal axis 38 of the pin 30; rotating the first and second lugs 12, 14 in a first direction A from a first lug position to a second lug position wherein the pin 30 slides through the first and second lugs 12, 14 and the first end 32 moves from the first lug 12 to the second lug 14 to uncouple the cylinder 138 from the jaw 126; engaging a lock element 92 biasingly supported on the second lug 12 into the groove 40 to retain the pin 30 at the second lug 12; and moving the cylinder 138 from between the spaced apart first and second lugs 12, 14.

The method of decoupling a cylinder 138 with the jaw 132 in a demolition tool 128 will now be described in reference to FIGS. 10 to 22. In an embodiment, the method may involve changing a first cylinder 138 with a second cylinder 238.

Figure 10:
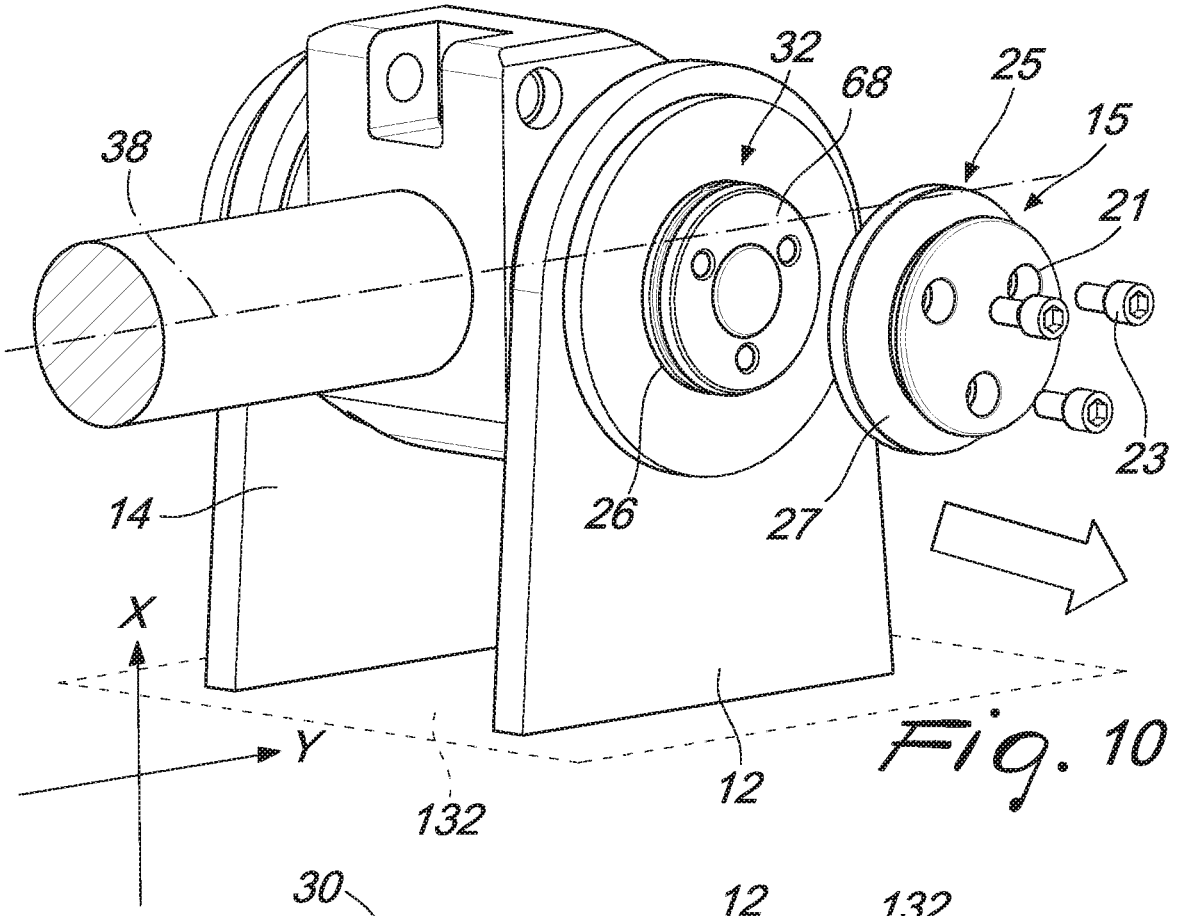

With reference to FIG. 10, the first and second lugs 12, 14 may be aligned along an X axis. First and second lugs 12, 14 may be parallel to the X axis and perpendicular to the Y axis. The first and second lugs 12, 14 may be in a first lug position. The longitudinal axis 38 of the pin 30 may be perpendicular to the X axis in the first lug position.

The relative mutual alignment of the first and second lugs 12, 14 may remain unchanged as the lugs 12, 14 remain in the respective fixed locations on the jaw 132. In an embodiment, the X axis may be a vertical alignment and the Y axis may be a horizontal alignment.

The method may comprise the pin 30 may be unlocked from the first lug 12. The first end 32 of the pin 30 may be unlocked from the first lug 12. Unlocking of the pin 30 may permit the pin 30 to be slidable through the first and second bores 26, 28 of the first and second lugs 12, 14. The pin 30 may have the groove 40 adjacent the first end 32. The groove 40 may be in a plane substantially transverse to the longitudinal axis 38 of the pin 30. The pin 30 may be slidable along the longitudinal axis 38.

In an embodiment, the lock mechanism 15 may be removed from engagement with the first end 32 and the first lug 12. Bolts 23 coupled to both the pin 30 and the lock mechanism 15 may be removed so as to permit the removal of the lock mechanism 15.

Figure 11:
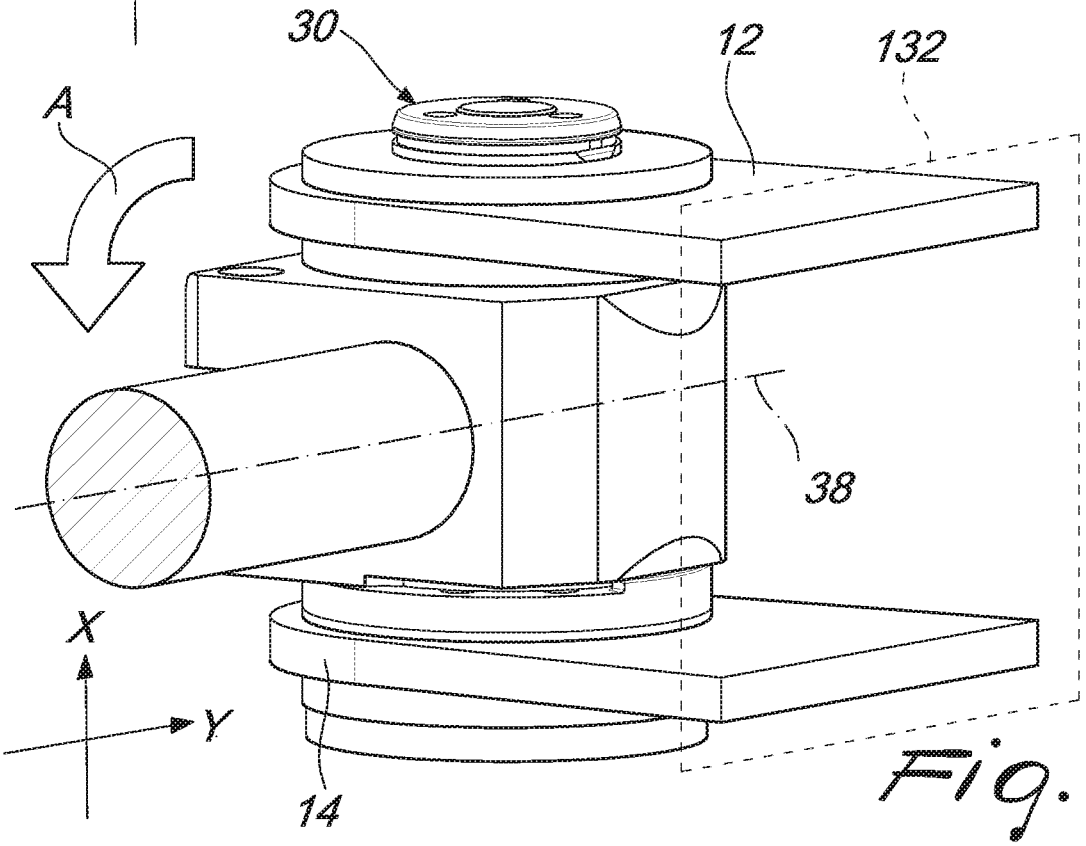

With reference to FIG. 11, the method may comprise rotating the first and second lugs 12, 14 along a first direction A. The first and second lugs 12, 14 may be rotated from alignment with the X axis towards the Y axis. The first and second lugs 12, 14 may move from the first lug position to a second lug position. At the second position the first lug 12 may be vertically elevated relative to the second lug 14.

In an embodiment, the first and second lugs 12, 14 may be rotated from the first lug position to the second lug position about an angle of 90 degrees. The first and second lugs 12, 14 may be rotated from alignment with the X axis to alignment with the Y axis. First and second lugs 12, 14 may be parallel to the Y axis and perpendicular to the X axis. The longitudinal axis 38 of the pin 30 may be perpendicular to the Y axis.

Figure 12:
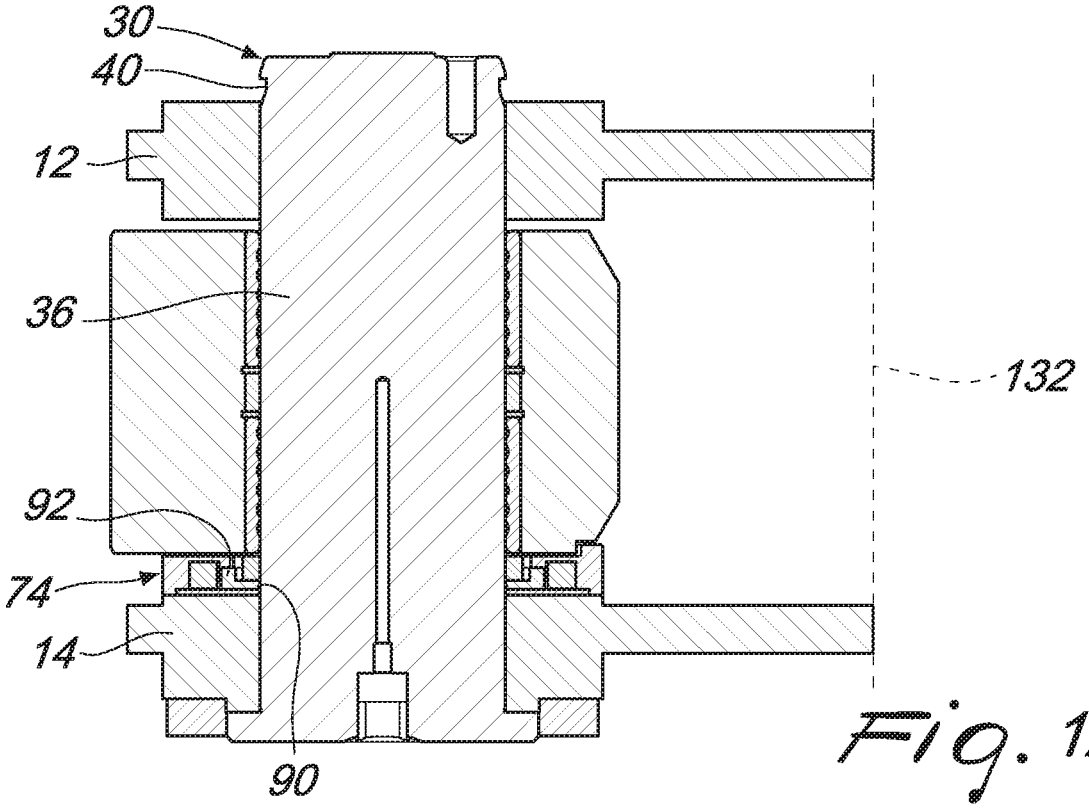

With reference to FIG. 12, the locking element 92 in the catch plate 74 may be in the stowed position. The access 120 may be free of a blocking element so as to permit the locking element 92 to move to the locked position. The locking element 92 may be urged against the pin 30. The lock side 94 may be in contact with the body 36 of the pin 30. Lock side 94 may remain in the stowed position while the opening 90 is blocked by the body 36.

Figure 13:
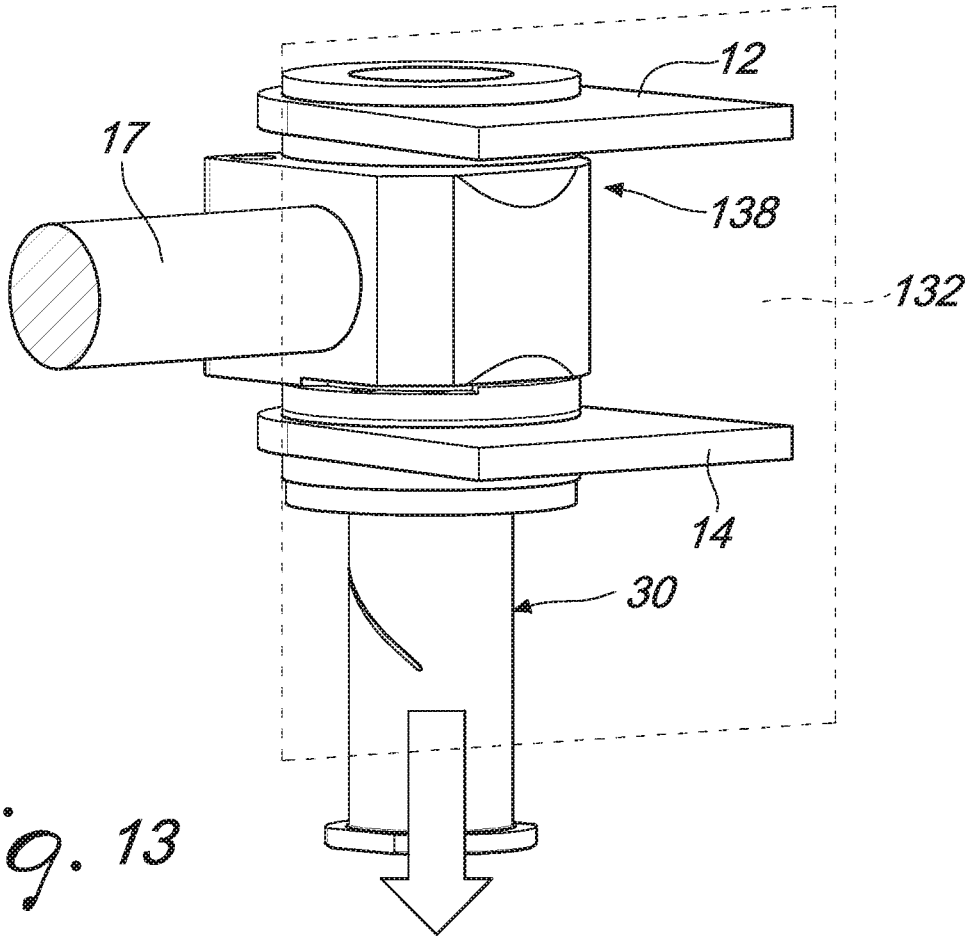

With reference to FIG. 13, at the second lug position, the pin 30 may slide relative to the first and second lugs 12, 14. The pin 30 may slide through the first and second lugs 12, 14. The pin 30 may slide relative to the first and second lugs 12, 14 as the pin 30 is no longer locked at the first lug 12. The first end 32 may move from the first lug 12 to the second lug 14 to uncouple the cylinder 138 from the first and second lugs 12, 14 so as to uncouple the cylinder 138 from jaw 132.

Figure 14:
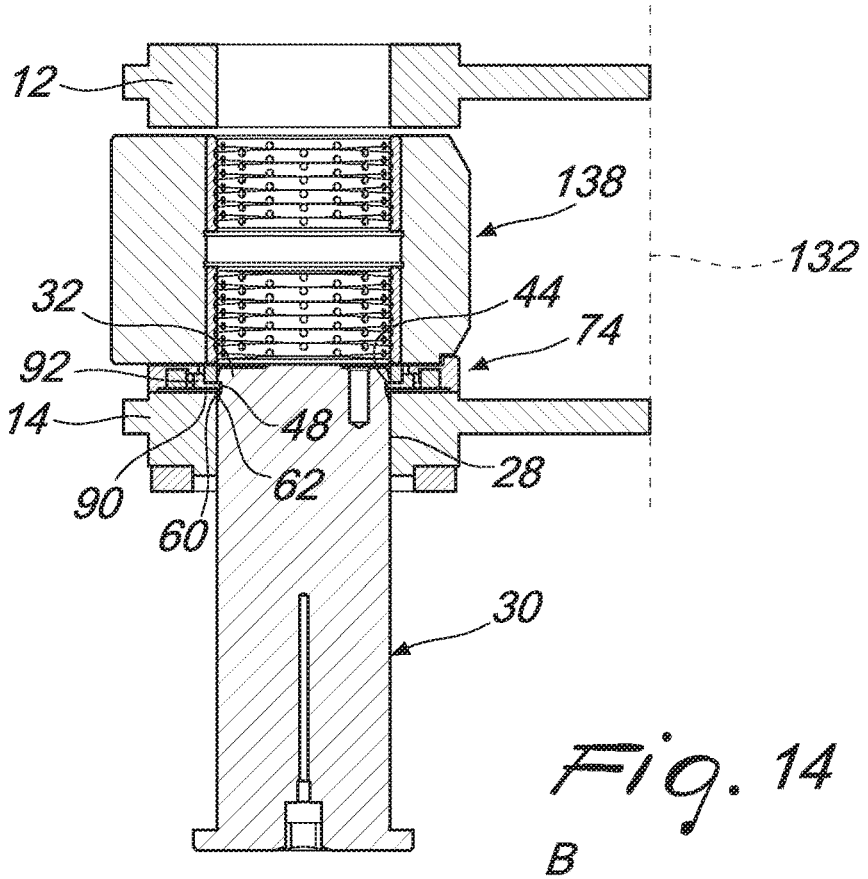

With reference to FIG. 14, the first end 32 of the pin 30 may be at the second lug 14. The pin 30 may be uncoupled from the cylinder 138. The cylinder 138 may be uncoupled from the first and second lugs 12, 14 and the jaw 132. The relative movement of the body 36 through the second bore 28 may move the groove 40 into alignment with the opening 90. The opening 90 may be unblocked with the groove 40 being positioned at the opening 90.

The locking element 92 may be biasingly supported on the second lug 14. The locking element 92 may be urged by the biasing element (not shown) to the locked position. The lock side 94 may engage into the groove 40. The pin 30 may be retained at the second lug 14 with the engagement of the locking element 92 into the groove 40. Lock side 94 may engage the platform 48 in the groove 40. The lock side 94 may abut the side wall 44 of the groove 40.

In an embodiment, lock side 94 may first engage the tapered portion 60 prior to engaging into the groove 40. In a further embodiment, lock portion 94 may engage into the flattened portion 62 prior to engaging into the groove 40.

The method may comprise moving the cylinder 138 from between the spaced apart first and second lugs 12, 14. The piston rod head 19 may be moved from between the first and second lugs 12, 14.

Figure 15:
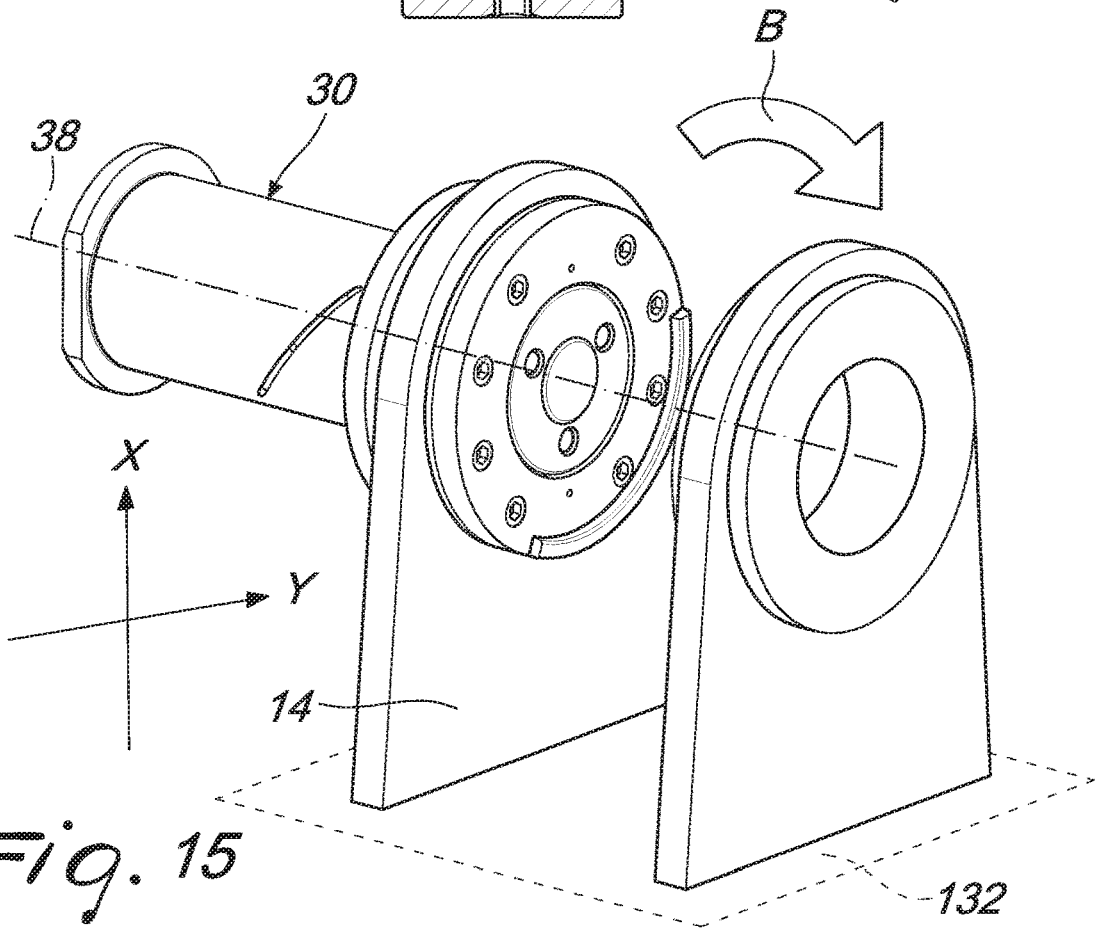

With reference to FIG. 15, the method may further comprise a step of rotating the first and second lugs 12, 14 from the second lug position towards the first lug position in a second direction B that is opposite to the first direction A. The first and second lugs 12, 14 may be rotated from alignment with the Y axis towards the X axis.

In an embodiment, the first and second lugs 12, 14 may be rotated from the second lug position to the first lug position. First and second lugs 12, 14 may be rotated about an angle of 90 degrees. The first and second lugs 12, 14 may be rotated from alignment with the Y axis to alignment with the X axis. First and second lugs 12, 14 may be parallel to the X axis and perpendicular to the Y axis. The longitudinal axis 38 of the pin 30 may be perpendicular to the X axis.

Figure 16:
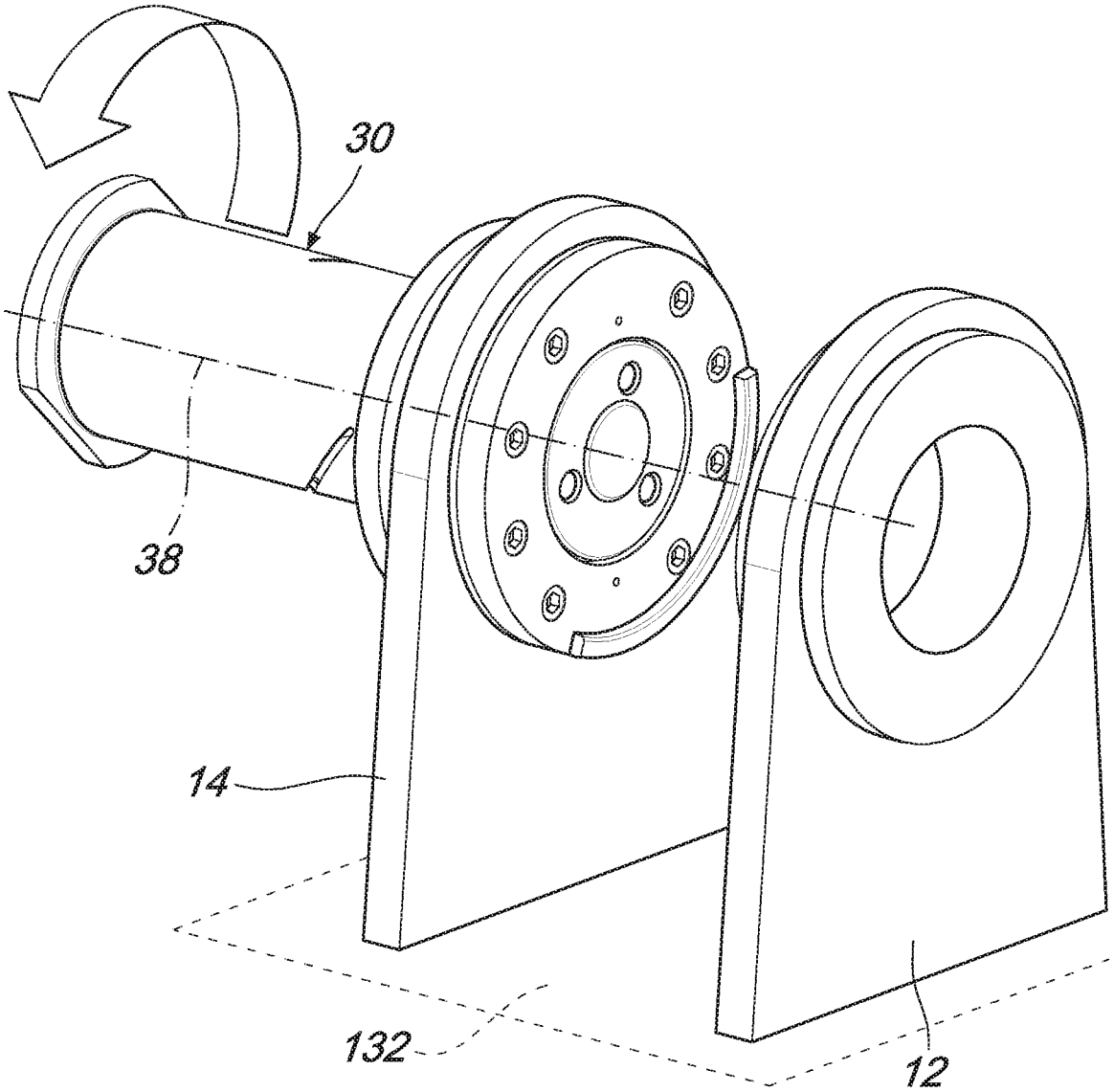

With reference to FIG. 16, the method may further comprise a step of rotating the pin 30. The pin 30 may be rotated so as to move the locking element 92 along the groove 40. Locking element 92 may move along the floor 46 of the groove 40. The locking element 92 may move from a first groove position to a second groove position. Axial movement of the pin 30 may be prevented at the second groove position. Pin 30 may be rotated in the clockwise or the anticlockwise direction. The locking element 92 may move along the floor 46 when moving from the platform 48 to the second groove position.

Pin 30 may be rotated between 20 degrees to 90 degrees about the longitudinal axis 38. In an embodiment, pin 30 may be rotated 90 degrees about the longitudinal axis 38. In a further embodiment, pin 30 may be rotated 45 degrees about the longitudinal axis 38.

With reference to FIG. 17, the method may further comprise the step of rotating the first and second lugs 12, 14 from the first lug position to a third lug position. The first and second lugs 12, 14 may be rotated along the second direction B. The first and second lugs 12, 14 may be rotated from alignment with the X axis towards the Y axis. At the third lug position the second lug 14 may be vertically elevated relative to the first lug 12.

In an embodiment, the first and second lugs 12, 14 may be rotated from the first lug position to the third lug position about an angle of 90 degrees. The first and second lugs 12, 14 may be rotated from alignment with the X axis to alignment with the Y axis. First and second lugs 12, 14 may be parallel to the Y axis and perpendicular to the X axis. The longitudinal axis 38 of the pin 30 may be perpendicular to the Y axis.

Figure 18:
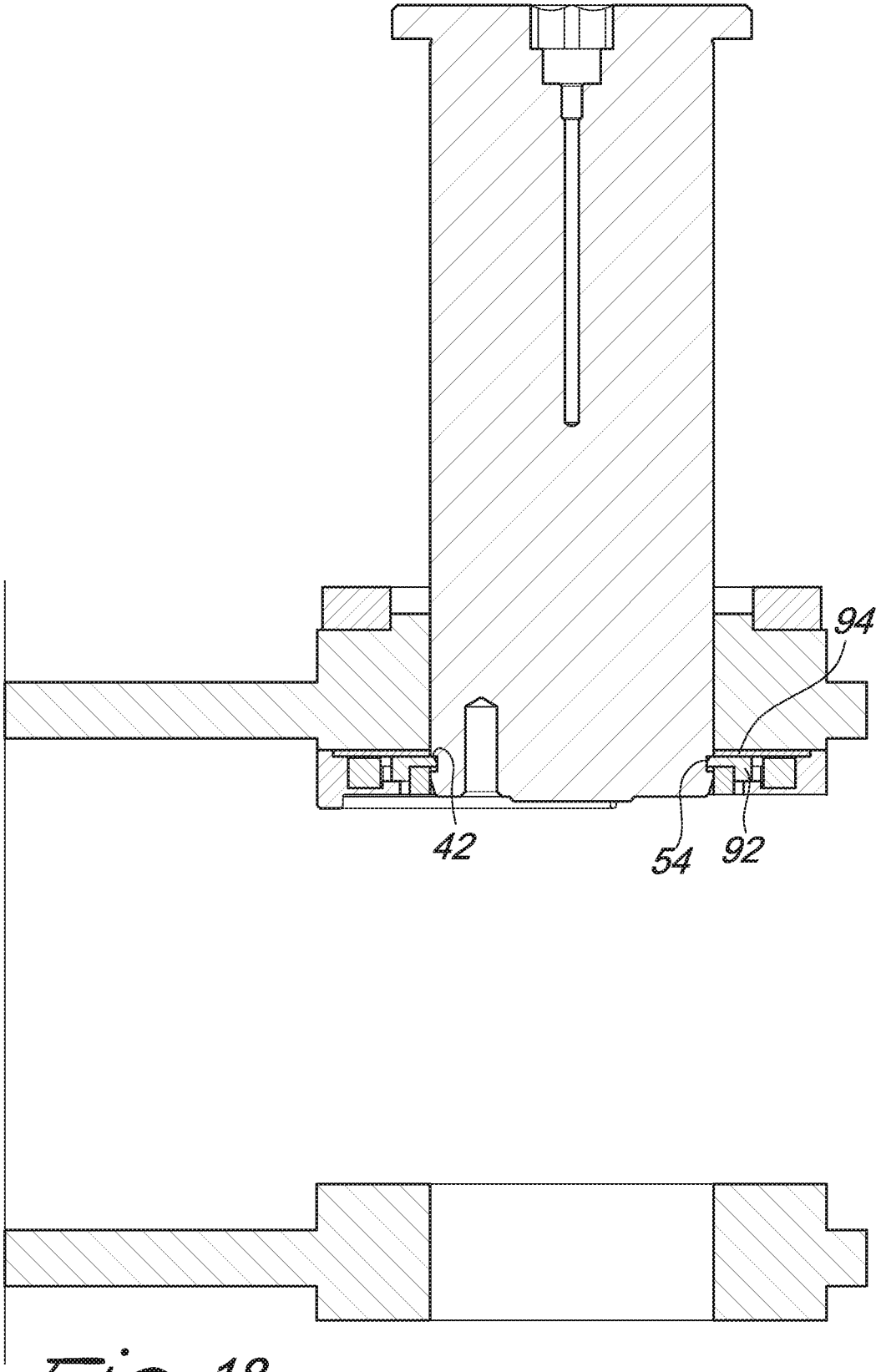

With reference to FIG. 18, the locking element 92 in the catch plate 74 may be in the locked position. The locking element 92 may be urged against the pin 30. The lock side 94 may be in contact with the groove 40. The lock side 94 may be positioned between the side walls 42, 44. Locking element 92 may retained in the groove 40 and the pin 30 may not be axially movable relative to the second lug 14. Lock side 94 may abut against the side wall 42.

Figure 19:
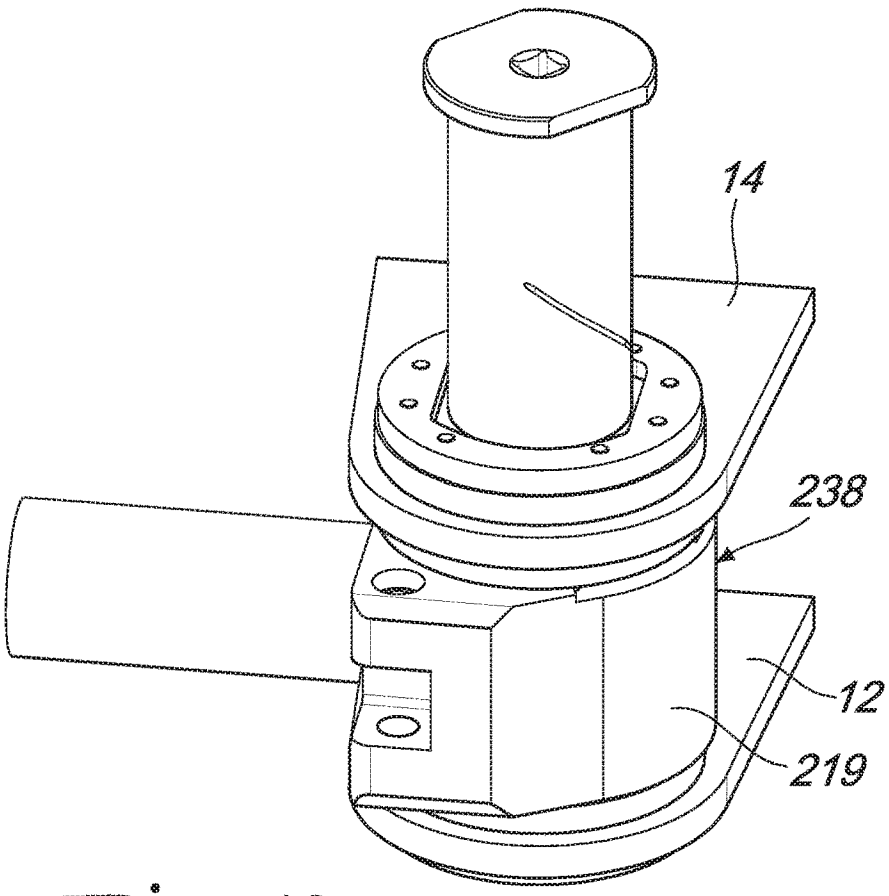

With reference to FIG. 19, the method may further comprise a step of positioning a second cylinder 238 between the spaced apart first and second lugs 12, 14. The piston head 219 may be positioned between the spaced apart first and second lugs 12, 14. The eye (not shown) of the piston rod head 219 may be aligned with the first and second bores 26, 28.

Figure 20:
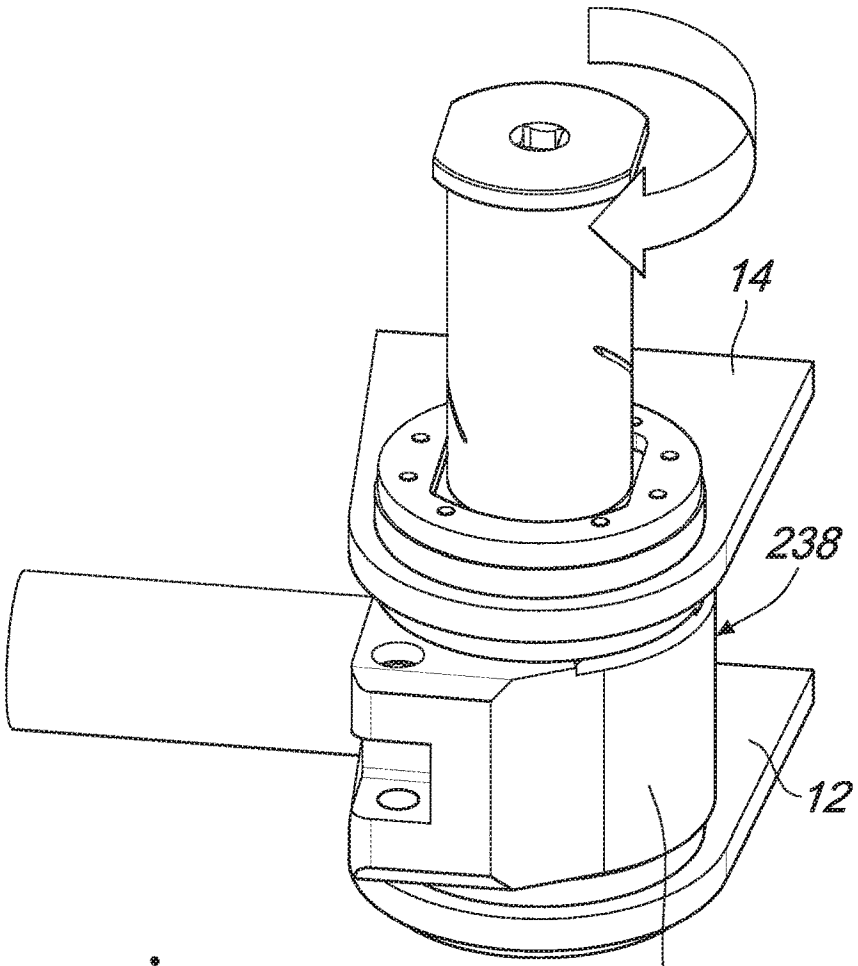

With reference to FIG. 20, the method may further comprise the step of rotating the pin 30. The pin 30 may be rotated so as to move the locking element 92 along the groove 40 from the second groove position to the first groove position so as to permit the pin 30 to slide from the second lug 14 to the first lug 12. Pin 30 may slide through the first and second lugs 12, 14. The first end 32 may move from the second lug 14 to the first lug 12 to couple the second cylinder 238 to the first and second lugs 12, 14 so as to couple the second cylinder 238 to the jaw 132.

Pin 30 may be rotated in the opposite direction. Pin 30 may be rotated between 20 degrees to 90 degrees about the longitudinal axis 38. In an embodiment, pin 30 may be rotated 90 degrees about the longitudinal axis 38. In a further embodiment, pin 30 may be rotated 45 degrees about the longitudinal axis 38. Pin 30 may be rotated such that the lock side 94 may be positioned at the platform 48. Lock side 94 may be adjacent to the tapered portion 60. In an embodiment, lock side 94 may be adjacent to the flattened portion 62. The absence of side wall 42 may enable the lock side 94 to move out of the groove 40 and into contact with the surface of the body 36.

The position of the pin 30 may be determined by the interaction of the aperture 73 in the second lug 14 and the limit plate 70. The specific orientation to position lock side 94 at the platform 48 may be determined by the limit plate 70 fitting into the aperture 73.

With reference to FIG. 21, the locking element 92 may be moved from the locked position to the stowed position. The body 36 may block the opening 90 and hold the locking element 92 in the stowed position as the pin 30 may slides from the second lug 14 to the first lug 12. The shoulder 72 of the limit plate 70 abutting the second lug 14 may restrict the pin 30 to slide further through the lugs 12, 14.

With reference to FIG. 22, the method may comprise a step of engaging the first end 32 of the pin 30 to the first lug 12. The lock mechanism 15 may be engaged to the first end 32 and to the first lug 12. The pin 30 may be locked to the first lug 12 by the lock mechanism so as to retain the second cylinder to the first and second lugs 12, 14 and the jaw 132.

The skilled person would appreciate that foregoing embodiments may be modified or combined to obtain the link assembly 10, pin 30, catch plate 74 or the method of the present disclosure.

INDUSTRIAL APPLICABILITY

This disclosure describes a method, a link assembly 10, a pin 30 and a catch plate 74 for decoupling a cylinder 138 in a demolition tool 128. The cylinder 138 may be connected to either an upper jaw 132 or a lower jaw 134 of a jaw set 126 of the demolition tool. The method and link assembly 10 may enable the connected cylinder 138 to be changed without lifting and positioning the pin 30. The pin 30 may be moved to a uncoupling position where the cylinder 138 may be uncoupled from the coupling assembly 10. The pin 30 may be moved to the coupling position once a second cylinder 238 is positioned in the link assembly 10. The pin 30 may be retained on the link assembly 10 by the catch plate 74.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

Where technical features mentioned in any claim are followed by reference signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein. Scope of the invention is thus indicated by the appended claims, rather than the foregoing description, and all changes that come within the meaning and range of equivalence of the claims are therefore intended to be embraced therein.

The disclosures in European Patent Application No. 14174769.1 from which this application claims priority are incorporated herein by reference.

The invention claimed is:

1. A method of decoupling a cylinder from a jaw in a demolition tool, the jaw having spaced apart first and second lugs, the first lug having a first bore and the second lug having a second bore, the method comprising the steps of:

unlocking a lock mechanism from a first end of a pin from a first lug wherein the pin has a groove adjacent the first end, the groove extending into the pin orthogonal to the longitudinal axis of the pin;

rotating the first and second lugs in a first direction (A) from a first lug position to a second lug position wherein the pin slides through the first and second lugs and the first end moves from the first lug to the second lug to uncouple the cylinder from the jaw;

engaging a radially biased locking element attached to the second lug into the groove to retain the pin at the second lug, the lock mechanism and the locking element permitting rotation of the pin; and moving the cylinder from between the spaced apart first and second lugs.

2. The method of claim 1 wherein at the second position the first lug is vertically elevated relative to the second lug.

3. The method of claim 1 wherein the first and second lugs are rotated from the first lug position to the second lug position about an angle of 90 degrees.

4. The method of claim 1 further comprising a step of rotating the first and second lugs from the second lug position to the first lug position in a second direction (B) opposite to the first direction (A).

5. The method of claim 4 further comprising a step of rotating the pin to move the locking element along the groove from a first groove position to a second groove position wherein axial movement is prevented at the second groove position.

6. The method of claim 5 wherein the groove has at least one platform at the first groove position.

7. The method of claim 5 further comprising a step of rotating first and second lugs in the second direction (B) from the first lug position to a third lug position.

8. The method of claim 7 wherein at the third lug position the second lug is vertically elevated relative to the first lug.

9. The method of claim 7 wherein the first and second lugs are rotated from the first lug position to the third lug position about an angle of 90 degrees.

10. The method of claim 9 further comprising the step of positioning a second cylinder between the spaced apart first and second lugs.

11. The method of claim 7 further comprising a step of rotating the pin to move the locking element along the groove from the second groove position to the first groove position so as to permit the pin to slide through the first and second lugs, the first end moving from the second lug to the first lug to couple the second cylinder to the jaw.

12. The method of claim 11 further comprising a step of engaging the first end of the pin to the first lug.

13. A link assembly for decoupling a cylinder from a jaw in a demolition tool, the link assembly comprising:

a first lug having a first bore and a second lug having a second bore, the first and second lugs being spaced apart;

a pin having a first end disposed adjacent the first lug and a second end disposed adjacent the second lug, the pin having a groove adjacent the first end, the groove extending into the pin orthogonal to a longitudinal axis of the pin;

a lock mechanism to lock the first end to the first lug; and a radially biased locking element attached to the second lug for engaging into the groove, the lock mechanism and the locking element permitting rotation of the pin.

14. The link assembly of claim 13 wherein the pin is rotatable relative to the second lug such that the locking element is movable along the groove between a first position and a second position.

15. The link assembly of claim 14 wherein the groove has a platform at the first position bordered by a side wall and at the second position bordered by side walls.

16. The link assembly of claim 15, wherein the groove has a first depth and the platform has a second depth larger than the first depth.

17. The link assembly of claim 15, wherein the pin includes a limit plate disposed at the second end, and the limit plate is configured to abut the second lug.

18. The link assembly of claim 17, wherein the limit plate includes at least one planar portion.

19. The link assembly of claim 13, wherein a catch plate is disposed on the second lug, and the locking element is slidably disposed in the catch plate.

20. The link assembly of claim 19, wherein the catch plate includes:

an annular body;

a bore extending through the annular body; and a slot extending radially outward from the bore, the locking element being disposed in the slot.

* * * * *